United States Patent [19]

Spitzer et al.

[11] 4,141,472

[45] Feb. 27, 1979

[54] AEROSOL CONTAINER WITH GAS-PERMEABLE MEMBRANE

[76] Inventors: Joseph G. Spitzer, 44 Coconut Row, Palm Beach, Fla. 33480; Marvin Small, 1100 Park Ave., New York, N.Y. 10805; Lloyd I. Osipow, 2 Fifth Ave., New York, N.Y. 10003; Dorothea C. Marra, 107 Fernwood Rd., Summit, N.J. 07901

[21] Appl. No.: 774,187

[22] Filed: Mar. 3, 1977

Related U.S. Application Data

[63] Continuation-in-part of Ser. No. 706,857, Jul. 19, 1976, abandoned.

[51] Int. Cl.[2] ..... B65D 83/14

[52] U.S. Cl. ..... 222/189; 137/199; 137/588; 222/402.18; 222/564; 239/333; 239/337

[58] Field of Search ..... 239/333, 337; 137/588, 137/199; 222/3, 4, 189, 402.1, 402.18, 422.24, 564

[56] References Cited

U.S. PATENT DOCUMENTS

| | | | |
|---|---|---|---|
| 2,183,639 | 12/1939 | Burdick et al. | 222/402.18 X |
| 3,326,230 | 6/1967 | Frank | 137/199 |
| 3,525,497 | 8/1970 | Zalan | 222/3 X |
| 3,912,131 | 10/1975 | Friedman et al. | 222/564 X |
| 4,035,303 | 7/1977 | Ufferfilge | 222/189 X |

*Primary Examiner*—David A. Scherbel

[57] ABSTRACT

An aerosol container is provided, especially intended for use with compositions containing liquefied flammable propellants, and having a gas-permeable membrane that is impermeable or at best only slowly permeable by liquefied propellants, and impeding liquid flow via a gas tap orifice through an open manually-operated delivery valve, at least when the container is tipped from the upright position beyond the horizontal towards the fully inverted position, the container comprising, in combination, a pressurizable container having at least one storage compartment for an aerosol composition and a liquefied propellant in which compartment liquefied propellant can assume an orientation according to orientation of the container between a horizontal and an upright position, and a horizontal and an inverted position; a delivery valve movable manually between open and closed positions, and including a valve stem and a delivery port; an aerosol-conveying passage in flow connection at one end with the storage compartment and at the other end with the delivery port, manipulation of the delivery valve opening and closing the passage to flow of aerosol composition and propellant from the storage compartment to the delivery port; and a gas-permeable membrane that is at best only slowly permeable by liquefied propellant, disposed across the line of flow from the storage compartment to the delivery port of liquefied propellant, and impeding flow of liquefied propellant to the delivery port, at least in an orientation of the container between the horizontal and an inverted position.

45 Claims, 15 Drawing Figures

FIG. 11
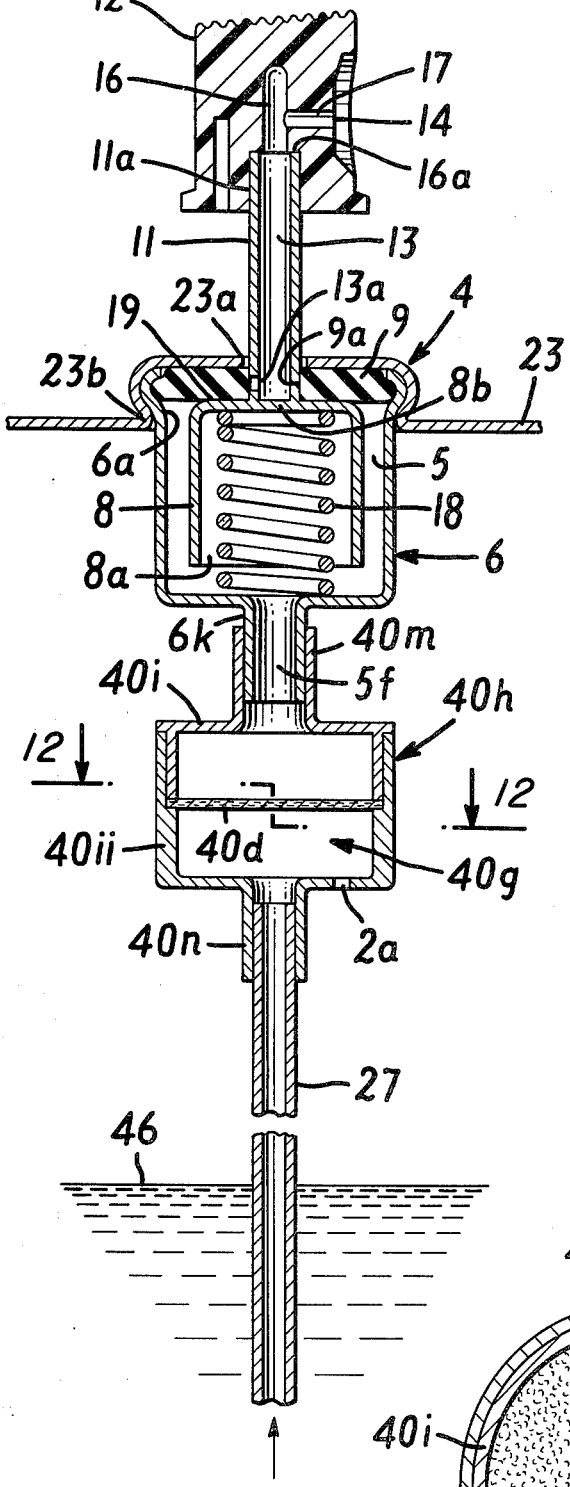
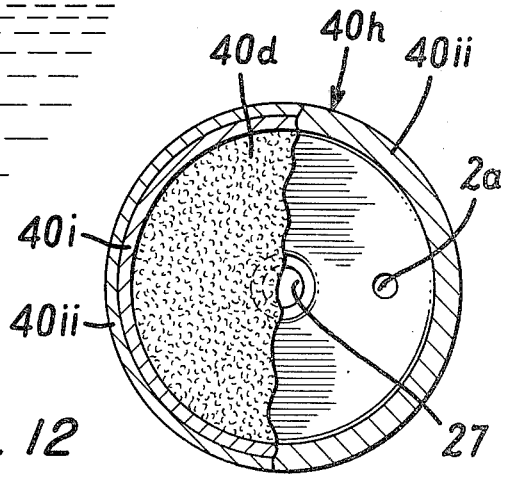
FIG. 12

AEROSOL CONTAINER WITH GAS-PERMEABLE MEMBRANE

This application is a continuation-in-part of Ser. No. 706,857, filed July 19, 1976, now abandoned.

SUMMARY OF THE PRIOR ART

Aerosol sprays are now widely used, particularly in the cosmetic, topical pharmaceutical and detergent fields, for delivery of an additive such as a cosmetic, pharmaceutical, or cleaning composition to a substrate such as the skin or other surface to be treated. Aerosol compositions are widely used as antiperspirants, deodorants, and hair sprays to direct the products to the skin or hair in the form of a finely-divided spray.

Much effort has been directed to the design of valves and valve delivery ports, nozzles or orifices or orifices which are capable of delivering finely-divided sprays, of which U.S. Pat. Nos. 3,083,917 and 3,083,918 patented Apr. 2, 1963, to Abplanalp et al, and No. 3,544,258, dated Dec. 1, 1970, to Presant et al, are exemplary. The latter patent describes a type of valve which is now rather common, giving a finely atomized spray, and having a vapor tap, which includes a mixing chamber provided with separate openings for the vapor phase and the liquid phase to be dispensed into the chamber, in combination with a valve actuator button of the mechanical breakup type. Such valves provide a soft spray with a swirling motion. Another design of valves of this type is described in U.S. Pat. No. 2,767,023. Valves with vapor taps are generally used where the spray is to be applied directly to the skin, since the spray is less cold.

Marsh U.S. Pat. No. 3,148,127 patented Sept. 8, 1964 describes a pressurized self-dispensing package of ingredients for use as a hair spray and comprising isobutane or similar propellant in one phase and an aqueous phase including the hair setting ingredient. The isobutane is in a relatively high proportion to the aqueous phase, and is exhausted slightly before the water phase has been entirely dispensed. A vapor tap type of valve is used having a 0.030 inch vapor tap orifice, a 0.030 inch liquid tap orifice, and a 0.018 inch valve stem orifice, with a mechanical breakup button. There is no disclosure of the relative proportions of propellant gas to liquid phase being dispensed.

Rabussier U.S. Pat. No. 3,260,421 patented July 12, 1966 describes an aerosol container for expelling an aqueous phase and a propellant phase, fitted with a vapor tap valve, and capillary dip tube. To achieve better blending of the phases before expulsion, the capillary dip tube is provided with a plurality of perforations 0.01 to 1.2 mm in diameter over its entire length, so that the two phases are admitted together in the valve chamber from the capillary dip tube, instead of the gas being admitted only through a vapor tap orifice, and the liquid through a dip tube as is normal. The propellant is blended in the liquid phase in an intermediate volume in proportion to the aqueous phase in the capillary dip tube.

Presant et al in U.S. Pat. No. 3,544,258, referred to above, discloses a vapor tap valve having a stem orifice 0.018 inch in diameter, a vapor tap 0.023 inch in diameter with a capillary dip tube 0.050 inch in diameter. The button orifice diameter is 0.016 inch. The composition dispensed is an aluminum antiperspirant comprising aluminum chlorhydroxide, water, alcohol and dimethyl ether. The aluminum chlorhydroxide is in solution in the water, and there is therefore only one liquid phase. The dimensions of the orifices provided for this composition are too small to avoid clogging, in dispensing an aluminum antiperspirant composition containing dispersed astringent salt particles.

The vapor tap type of valve is effective in providing fine sprays. However, it requires a high proportion of propellant, relative to the amount of active ingredients dispensed per unit time. A vapor tap requires a large amount of propellant gas, because the tap introduces more propellant gas into each squirt of liquid. Such valves therefore require aerosol compositions having a rather high proportion of propellant. A high propellant proportion is undesirable, however. The fluorocarbon propellants are thought to be deleterious, in that they are believed to accumulate in the stratosphere, where they may possibly interfere with the protective ozone layer there. The hydrocarbon propellants are flammable, and their porportion must be restricted to avoid a flame hazard. Moreover, both these types of propellants, and especially the fluorocarbons, have become rather expensive.

Another problem with such valves is that since they deliver a liquid propellant-aerosol composition mixture, and have valve passages in which a residue of liquid remains following the squirt, evaporation of the liquid in the valve passages after the squirt may lead to deposition of solid materials upon evaporation of liquids, and valve clogging. This problem has given rise to a number of expedients, to prevent the deposition of solid materials in a form which can result in clogging.

Consequently, it has long been the practice to employ large amounts of liquefied propellant, say 50% by weight or more, to obtain fine droplets of liquid sprays or fine powder sprays, and a rather small solids content, certainly less than 10%, and normally less than 5%. The fine sprays result from the violent boiling of the liquefied propellant after it has left the container. A case in point is exemplified by the dispersion-type aerosol antiperspirants, which contain 5% or less of astringent powder dispersed in liquefied propellant. It has not been possible to use substantially higher concentrations of astringents without encountering severe clogging problems.

There is considerable current interest in the substitution of compressed gases for fluorocarbons and hydrocarbons as propellants to obtain fine aerosol sprays. The reasons include the low cost of compressed gases, the flammability of liqueified hydrocarbon propellants, and the theorized hazard to the ozone layer of liquefied fluorocarbon propellants. Reasonably fine sprays of alcoholic solutions have been obtained using carbon dioxide at 90 psig and valving systems with very fine orifices. These orifices are so small that dispersed solids cannot be tolerated, and even inadvertent contamination with dust will cause clogging. Thus, a typical system will employ a 0.014 inch capillary dip tube, a 0.010 inch valve stem orifice, and a 0.008 inch orifice in a mechanical break-up actuator button. However, only limited variations in delivery rates are possible, since the use of significantly larger orifices will coarsen the spray droplets. Moreover, these fine sprays of alcoholic solutions are flammable.

Thus far, the art has not succeeded in obtaining fine aerosol sprays using aqueous solutions with compressed gases. The reasons for this are that water has a higher surface tension than alcohol (ethanol or isopropanol)

and is also a poorer solvent for the compressed gases, particularly carbon dioxide, which is preferred. All of these factors adversely affect the break-up of droplets to form a fine spray.

Special designs of the delivery port and valve passages have been proposed, to prevent the deposit of solid materials in a manner such that clogging can result. U.S. Pat. No. 3,544,258 provides a structure which is especially designed to avoid this difficulty, for example. Such designs result however in a container and valve system which is rather expensive to produce, complicated to assemble because of the numerous parts, and more prone to failure because of its complexity.

In accordance with U.S. Pat. No. 3,970,219, aerosol containers are provided that are capable of delivering a foamed aerosol composition. The aerosol composition is foamed inside the aerosol container, and delivered through the valve of the aerosol container as a foam or collapsed foam. Fine droplets are formed from the foamed aerosol compositions, due at least in part to collapse of thin foam cell walls into fine droplets. The propellant serves to foam the liquid within the container, forming a foamed aerosol composition, and propels from the container through the valve and delivery port both any foam and any droplets that form when the foam collapses.

With conventional aerosol containers, a substantial proportion of the propellant is in liquid form as the aerosol composition passes through the valve and delivery port. Propellant evaporates as the spray travels through the air, and it continues to evaporate after the spray has landed on a surface. The heat of vaporization is taken from the surface, and the spray consequently feels cold. This is wasteful of propellant, as is readily evidenced by the coldness of sprays from conventional aerosol containers. In contrast, in the invention of U.S. Pat. No. 3,970,219, the propellant is in gaseous form when expelled with the liquid. The propellant is not wasted, therefore, and since there is substantially no liquid propellant to take up heat upon vaporization, the spray is not cold.

The aerosol containers in accordance with the invention of U.S. Pat. No. 3,970,219 accordingly foam an aerosol composition therein prior to expulsion from the container, and then expel the resulting foamed aerosol composition. These aerosol containers comprise, in combination, a pressurizable container having a valve movable between open and closed positions, with a valve stem, and a foam-conveying passage therethrough, in flow connection with a delivery port; bias means for holding the valve in a closed position; and means for manipulating the valve against the bias means to an open position, for expulsion of aerosol composition foamed within the container via the valve passage and delivery port; means defining at least two separate compartments in the container, of which a first compartment is in direct flow connection with the valve passage, and a second compartment is in flow connection with the valve passage only via the first compartment; and porous bubbler means having through pores interposed between the first and second compartments with the through pores communicating the compartments, the pores being of sufficiently small dimensions to restrict flow of propellant gas from the second compartment therethrough and form bubbles of such gas in liquid aerosol composition across the line of flow from the bubbler to the valve, thereby to foam the aerosol composition upon opening of the valve to atmospheric pressure, and to expel foamed aerosol composition through the open valve.

U.S. patent application Ser. No. 670,913, filed Mar. 26, 1976, now U.S. Pat. No. 4,019,657 patented Apr. 26, 1977 provides another form of foam-type aerosol container, in which the aerosol composition therein is foamed prior to expulsion from the container, and then the resulting foamed aerosol composition is expelled. These aerosol containers comprise, in combination, a pressurizable container having a valve movable between open and closed positions, with a valve stem, and a foam-conveying passage therethrough, in flow connection with a delivery port; bias means for holding the valve in a closed position; and means for manipulating the valve against the bias means to an open position for expulsion via the valve passage and delivery port of aerosol composition foamed within the container; means defining at least two separate compartments in the container, of which a first compartment has a volume of at least 0.5 cc and is in direct flow connection with the valve passage, and a second compartment is in flow connection with the valve passage only via the first compartment; at least one first liquid tap orifice having a diameter within the range from about 0.012 to about 0.2 cm and communicating the first and another compartment for flow of liquid aerosol composition into the first compartment, and of sufficiently small dimensions to restrict flow of liquid aerosol composition therethrough; the ratio of first compartment volume/first orifice diameter being from about 10 and preferably from about 20/x to about 400/x, and preferably about 200/x, where x is 1 when the the orifice length is less than 1 cm, and 2 when the orifice length is 1 cm or more; at least one second gas tap orifice having a total cross-sectional open area within the range from about $7 \times 10^{-6}$ to about $20 \times 10^{-4}$ in$^2$ ($4 \times 10^{-5}$ to $1.3 \times 10^{-2}$ cm$^2$), a single orifice having a diameter within the range from about 0.003 to about 0.05 inch (0.007 to 0.13 cm) and communicating the first and second compartments for flow of propellant gas into the first compartment from the second compartment therethrough, and of sufficiently small dimensions to restrict flow of propellent gas and form bubbles of such gas in liquid aerosol composition across the line of flow thereof to the valve, thereby to foam the aerosol composition upon opening of the valve to atmospheric pressure, and to expel the foamed aerosol composition through the open valve.

The advantages of foaming the aerosol composition within the container are twofold. Because the propellant is in gaseous form (having been converted to gas in the foaming) there is no liquid propellant to expel, so all propellant is usefully converted into gas, for propulsion and foaming, before being expelled. Because the foamed liquid aerosol composition has a higher volume than the liquid composition, and the expulsion rate is in terms of volume per unit time, less liquid is expelled per unit time. Thus, in effect, the liquid is expelled at a lower delivery rate, which conserves propellant per unit squirt, and means a higher active concentration must be used, to obtain an equivalent delivery rate of active ingredient. Also, since there is less liquid, there is a negligible clogging problem, even at a two or three times higher active concentration.

The disadvantage of foaming however is the need to provide space for the foaming to take place, which requires either a larger container or a smaller unit volume of composition per container.

U.S. patent application Ser. No. 706,857 filed July 19, 1976 shows that a low delivery rate can be achieved without the necessity of providing a foam chamber or space within the aerosol container, if the volume proportion of gas to liquid in the blend dispensed from the container is within the range from about 10:1 to about 40:1, and preferably within the range from about 15:1 to about 30:1. This is a sufficient proportion of gas to liquid to form a foam, such as is formed and dispensed from the foam type aerosol containers of Pat. Nos. 3,970,219 and referred to above, and a very much higher proportion of gas to liquid than has previously been blended with the liquid for expulsion purposes in conventional aerosol containers, such as the vapor tap containers of the Presant U.S. Pat. No. 3,544,258, referred to above. At such high proportions of gas to liquid, the formation of foam is possible, and even probable, despite the small volume of the blending space provided, but foam formation, if it occurs, is so fleeting, having a life of at most a fraction of a second, that a foam cannot be detected by ordinary means, due to the small dimensions of the open spaces in which it may exist, i.e., the blending space and valve passages, and the shortness of the delivery time from blending of gas and liquid to expulsion. However, the proportion of gas to liquid in the blend that is expelled can be determined, and when the proportion is in excess of 10:1, the delivery rate of liquid from the aerosol container is very low, and thus, the objective of the invention is achieved. Whether or not a foam is formed is therefore of no significance, except as a possible theoretical explanation of the phenomenon.

Accordingly, Ser. No. 706,857 provides a process for dispensing a spray containing a low proportion of liquid, with a high proportion of propellant in gaseous form, by blending gas and liquid within the aerosol container prior to expulsion at a ratio of gas:liquid within the range from about 10:1 to about 40:1, and preferably from about 15:1 to about 30:1, with the result that a blend containing this low proportion of liquid and high proportion of gas is expelled from the container, and the proportion of liquid composition expelled per unit time correspondingly reduced.

The aerosol container in accordance with Ser. No. 706,857 comprises, in combination, a pressurizable container having a valve movable between open and closed positions, a valve stem, and a delivery port; a valve stem orifice in the valve stem in flow connection at one end with a blending space and at the other end with an aerosol-conveying valve stem passage leading to the delivery port; the valve stem orifice having a diameter within the range from about 0.50 to about 0.65 mm; bias means for holding the valve in a closed position; means for manipulating the valve against the bias means to an open position for expulsion of aerosol composition via the valve stem orifice to the delivery port; wall means defining the blending space and separating the blending space from liquid aerosol composition and propellant within the container; at least one liquid tap orifice through the wall means, having a cross-sectional open area within the range from about 0.4 and 0.6 $mm^2$ for flow of liquid aerosol composition into the blending space; at least one vapor tap orifice through the wall means, having a cross-sectional open area within the range from about 0.4 to about 0.8 $mm^2$ for flow of propellant into the blending space; the ratio of liquid tap orifice to vapor tap orifice cross-sectional open area being within the range from about 0.5 to about 0.9; the open areas of the liquid tap orifice and vapor tap orifice being selected within the stated ranges to provide a volume ratio of propellant gas:liquid aerosol composition within the range from about 10:1 to about 40:1, thereby limiting the delivery rate of liquid aerosol composition from the container when the valve is opened.

The dimensions of such aerosol containers are particularly suited to the dispensing of antiperspirant compositions in which the astringent salt is in dispersed form, where orifices of smaller dimensions are readily susceptible to clogging. Smaller dimensions can be used with compositions in which the active components are in solution, such as deodorants and hair sprays. Volume ratio requirements will vary somewhat depending on the aerosol composition. In general, the volume ratio of propellant gas:liquid aerosol composition within the range from about 8:1 to about 40:1 is applicable to any aerosol composition containing a flammable propellant. The flammability of the spray is greatly reduced when the container is actuated in its normal, vertical position. At a higher than about 40:1 ratio, the propellant is exhausted too rapidly, and an excessive amount of non-propellant composition remains in the container.

The aerosol containers in accordance with Ser. No. 706,857 have provision for expelling these high ratios of gas:liquid when the container is actuated in a normal or partially tilted position. However, if the container is inclined or tipped enough, or inverted, so that the gas phase can pass through the liquid tap orifice, and the liquid phase can pass through the vapor tap orifice, the gas:liquid ratio expelled is less than about 8:1, and flammability is accordingly increased.

At some angle of tilt as the container is tipped from an upright towards a horizontal position, liquid phase can reach and pass through the gas tap orifice, and perhaps even both liquid tap and vapor tap orifices. This can result in an extremely flammable spray. Whether the latter condition actually occurs depends on the configuration of the container, the bend of the dip tube, and the liquid fill of the container.

Aerosol containers are commonly filled so that the liquid phase occupies 60% of the total capacity at 21° C. With this fill in a container with minimum doming, a straight dip tube, and a vapor tap orifice about 0.6 mm in diameter, off-center and positioned downward when the container is horizontal, both gas and liquid tap orifices will be covered by liquid when the container is positioned so that the valve is in the range of about −5° (below horizontal) to +5° (above horizontal). If the dip tube bends downward when the container is horizontal, the range in valve position in which both taps are covered by liquid may extend to about −30° (below the horizontal) to about +5° (above the horizontal). The extent or span of this range will depend on the dimensions of the container. The larger the ratio of diameter:-height, the wider the span of the range.

The problem also arises in the foam-type aerosol containers of U.S. Pat. No. 4,019,657. At any angle where the valve is below the horizontal, the foam chamber can fill with the liquid phase, and the gas phase under high pressure will project this liquid from the container, when the delivery valve is opened.

With the aerosol containers of U.S. Pat. No. 3,970,219, the problem of a flammable spray due to the presence of a flammable liquefied propellant does not exist. Since the propellant is expelled only in gaseous form, very little liquid propellant need be present, and it will not cover the bubbler in any position. A flammability problem will arise only in the event that the liquid in the foam chamber is flammable. Then, if the foam chamber is more than 50% full, at any angle between the horizontal to an inverted orientation, the liquid will be expelled without benefit of foaming, and the spray will be flammable.

This problem is not normally encountered if the aerosol composition contains a preponderance of the nonflammable fluorocarbon propellants, unless the composition contains a high proportion of alcohol, such as hair sprays, when actuated in the normal upright position. If, however, nonflammable fluorocarbons cannot be used, and it is necessary to employ flammable hydrocarbon propellants, at least in a proportion where the liquid phase is flammable, then aerosol containers equipped with conventional vapor tap valves will pose a considerable fire hazard even when used in the normal, upright position. This hazard is posed by the containers of U.S. Pat. Nos. 3,970,219 and of Ser. Nos. 670,913 and of 706,857 only wnen the delivery valves of such containers are actuated with the container in an abnormal position ranging between below the horizontal to fully inverted.

In accordance with Ser. No. 754,471, filed Dec. 27, 1976 this difficulty is overcome by including in combination with the delivery valve an overriding shut-off valve which, although normally open when the container is upright, automatically closes off flow of liquid through the delivery valve from the container to the delivery port at some limiting angle at or below the horizontal as the top of the container is brought below the horizontal, towards the fully inverted position. The shut-off valve will normally have closed fully before the container is fully inverted. The angle to the horizontal at which the valve must close is of course the angle at which liquid can flow to the delivery port and escape as liquid from the container, without benefit of a high gas ratio. This can be within the range from 0° (i.e. horizontal) to −90°, and preferably is from −5° to −45°, below the horizontal.

In this type of container, it is generally not possible to dispense the liquid contents of the container by opening the delivery valve unless the container is so oriented that a sufficient ratio of gas is expelled with the liquid phase. The container must be held in a fully upright position, or at least in such a position that the valve is above the horizontal; otherwise, the liquid phase cannot flow through the open delivery valve.

The aerosol container in accordance with Ser. No. 754,471, comprises, in combination, a pressurizable container having at least one storage compartment for an aerosol composition and a liquefied propellant in which compartment liquefied propellant can assume an orientation according to orientation of the container between a horizontal and an upright position, and a horizontal and an inverted position; a delivery valve movable manually between open and closed positions, and including a valve stem and a delivery port; an aerosol-conveying passage in flow connection at one end with the storage compartment and at the other end with the delivery port, manipulation of the delivery valve opening and closing the passage to flow of aerosol composition and propellant from the storage compartment to the delivery port; and a shut-off valve responsive to orientation of the container to move automatically between positions opening and closing off flow of liquefied propellant to the delivery port, the shut-off valve moving into an open position in an orientation of the container between a horizontal and an upright position, and moving into a closed position in an orientation of the container between the horizontal and an inverted position.

SUMMARY OF THE INVENTION

The instant invention provides an alternative to the shut-off valve of Ser. No. 754,471. In lieu of a valve, the invention utilizes a gas-permeable membrane that is either impermeable or at best only slowly permeable by liquefied propellants, thereby slowing the flow of liquefied propellant to the delivery port sufficiently that in the time for delivery of a dose of aerosol composition, the liquefied propellant cannot reach the delivery port, and thus does not escape from the container with the delivery of aerosol composition, if any.

The aerosol container of the invention comprises, in combination, a pressurizable container having at least one storage compartment for an aerosol composition and a liquefied propellant in which compartment propellant can assume an orientation according to orientation of the container between a horizontal and an upright position, and a horizontal and an inverted position; a delivery valve movable manually between open and closed positions, and including a valve stem and a delivery port; an aerosol-conveying passage in flow connection at one end with the storage compartment and at the other end with the delivery port, manipulation of the delivery valve opening and closing the passage to flow of aerosol composition and propellant from the storage compartment to the delivery port; and a gas-permeable membrane that is at best only slowly permeable by liquefied propellants, disposed across the line of flow from the storage compartment to the delivery port of liquefied propellant, and impeding flow of liquefied propellant to the delivery port, at least in an orientation of the container between the horizontal and an inverted position.

DETAILED DESCRIPTION OF THE INVENTION

The gas permeable membrane can be placed in any part of the line of flow from the storage compartment to the delivery port. If there be a gas tap orifice, it should be downstream of the gas tap orifice. Whether or not there is a gas tap orifice, it can be across the line of flow through the delivery valve, or the delivery valve chamber, or the aerosol conveying passage through the valve stem. Other locations will be evident to those familiar with aerosol containers and delivery valve systems therefor.

In order to increase the length of the time interval required for liquefied propellant to reach the delivery port after passing through the membrane, a further impedance can be disposed across the line of flow therebetween, downstream of the membrane. This impedance can take any of several forms.

A baffle can be introduced, in combination with a storage space, in which liquefied propellant is collected after passing through the membrane and can flow beyond only by overflow when the space is full. This extends the time interval by the time required to fill the space.

Additional membranes can be interposed in series, with storage spaces therebetween. These increase the time interval by the time required to fill the space and pass through the membrane in each stage. A labyrinth can be interposed in the form of a long helically wound tube, or a labyrinthine baffled chamber.

In all of these variations, the impedance must allow drainage of liquefied propellant therefrom when the container is returned from an inverted or below the horizontal orientation to an upright or above the horizontal orientation. If drainage is incomplete, gas flow therethrough may be blocked or at least impeded, and this would of course lead to malfunction when the delivery valve of the container is opened with the container in an upright position. It is therefore important that the design allow unimpeded gas flow even when liquid drainage is incomplete.

A preferred embodiment of delivery valve is of the vapor tap type, comprising a valve movable manually between open and closed positions; a valve stem and a delivery port; a valve stem orifice in the valve stem, in flow connection at one end with a blending space, and at the other end with an aerosol-conveying valve stem passage leading to the delivery port; bias means for holding the delivery valve in a closed position; means for manipulating the valve against the bias means to an open position, for expulsion of aerosol composition via the valve stem orifice to the delivery port; wall means defining a blending space, and separating the blending space from liquid aerosol composition and propellant within the container; at least one liquid tap orifice through the wall means; at least one vapor tap orifice through the wall means; and a gas-permeable membrane that is impermeable or only slowly permeable to liquefied propellants and disposed across the line of flow via the vapor tap orifice to the delivery port, allowing gas flow but impeding liquefied propellant flow to the delivery port sufficiently to prevent liquefied propellant flowing through the membrane and vapor tap orifice to escape through the delivery port via the aerosol-conveying valve stem passage during the normal time interval that the delivery valve is in the open position, at least when the container is fully inverted.

In a preferred embodiment of this type of valve, where particulate solids are not present, the valve stem orifice has a diameter within the range from about 0.33 to about 0.65 mm, at least one liquid tap orifice having a cross-sectional open area within the range from about 0.2 to about 0.8 $mm^2$, and at least one vapor tap orifice having a cross-sectional open area within the range from about 0.2 to about 0.8 $mm^2$, the ratio of liquid tap orifice to vapor tap orifice cross-sectional open area being within the range from about 0.5 to about 2.5; the open areas of the liquid tap orifice and vapor tap orifice being selected within the stated ranges to provide a volume ratio of propellant gas:liquid aerosol composition within the range from about 8:1 to about 40:1, limiting the delivery rate of liquid aerosol composition from the container when the valve is open.

In a preferred embodiment of this type of valve, where particulate solids are present, the valve stem orifice has a diameter within the range from about 0.50 to about 0.65 mm, at least one liquid tap orifice having a cross-sectional open area within the range from about 0.4 to about 0.8 $mm^2$, and at least one vapor tap orifice having a cross-sectional open area within the range from about 0.3 to about 0.8 $mm^2$, the ratio of liquid tap orifice to vapor tap orifice cross-sectional open area being within the range from about 0.5 to about 2.3; the open areas of the liquid tap orifice and vapor tap orifice being selected within the stated ranges to provide a volume ratio of propellant gas:liquid aerosol composition within the range from about 8:1 to about 40:1, limiting the delivery rate of liquid aerosol composition from the container when the valve is open.

In the special case where the liquid tap orifice is a capillary dip tube, and particulate solids are not present, the cross-sectional open area thereof is within the range from about 0.2 to about 1.8 $mm^2$, for flow of liquid aerosol composition into the blending space, and at least one vapor tap orifice through the wall means has a cross-sectional open area within the range from about 0.2 to about 0.8 $mm^2$ for flow of propellant gas into the blending space; and the ratio of capillary dip tube to vapor tap orifice cross-sectional oepn area is within the range from about 1.0 to about 3.2.

In the special case where the liquid tap orifice is a capillary dip tube, where the solids are present, the cross-sectional open area thereof is within the range from about 0.6 to about 1.8 $mm^2$, for flow of liquid aerosol composition into the blending space, and at least one vapor tap orifice through the wall means has a cross-sectional open area within the range from about 0.3 to about 0.8 $mm^2$ for flow of propellant gas into the blending space; and the ratio of capillary tube to vapor tap orifice cross-sectional open area is within the range from about 1.0 to about 3.2.

The controlling orifices to achieve the desired proportion of gas and liquid in the blend dispensed from the container are the vapor tap orifice, the liquid tap orifice (or in the case of a capillary dip tube, the capillary dip tube), and the valve stem orifice. The open areas of these orifices and the ratio of liquid tap orifice to vapor tap orifice open area should be controlled within the stated ranges. However, these dimensions are in no way critical to the operation of the shut-off valve, which can be used advantageously with delivery valves having other dimensions.

The valve delivery system normally includes, in addition to the valve stem orifice, an actuator orifice at the end of the passage through the actuator of the valve. The valve delivery system from the blending chamber through the valve stem and actuator to the delivery port thus includes, in flow sequence towards the delivery end, the valve stem orifice, the valve stem passage, and the actuator orifice. The controlling orifice in this sequence is the valve stem orifice, and the actuator orifice will normally have a diameter the same as or greater than the valve stem orifice, but not necessarily.

In the unlikely event that the actuator orifice has an open area that is less than the valve stem orifice, then the actuator orifice becomes the controlling orifice, downstream of the blending chamber, and diameter may in that event be within the range from about 0.33 to about 0.65 mm when solids are not present, and from about 0.45 to about 0.65 mm when solids are present.

The delivery valve is disposed in a valve housing, which may also include or is in flow connection with the wall means defining the blending space. The blending space is of limited volume, insufficient to constitute a foam chamber, and only as large as required for thorough blending of gas and liquid therein before reaching the valve. A valve member may be movably disposed in the blending space, for movement between open and closed positions, away from and towards a valve seat at the inner end of the valve stem passage, with which the blending space is in flow connection when the valve is open.

The blending space can be small in volume, and no larger than the volume needed for full movement of a valve member therein. It can also be a narrow passage, large enough at one end for the valve member, and merging indistinguishably with the dip tube or tail piece passage. Any conventional mixing chamber in a vapor tap valve assembly will serve.

The volume of the blending space does not usually exceed 1 cc, and can be as small as 0.1 cc, but it is preferably from 0.5 to 1 cc.

The liquid tap orifice communicates the blending space directly or indirectly with a capillary dip tube or a standard dip tube. A standard or capillary dip tube normally extends into the liquid composition or phase in the aerosol container, and may reach to the bottom of the container. A tail piece may be provided (but is not essential) at the valve housing as a coupling for linking the dip tube to the blending space within the valve housing. The tail piece when present has a through passage in fluid flow connection with the liquid composition or phase in the container, via the dip tube, and this passage leads directly into the blending space. The liquid tap orifice in this embodiments is an orifice or constriction in the passage, at the blending space end, at the dip tube end, or intermediate the ends. The orifice can also be in direct communication with the dip tube, in the event the tail piece is omitted. When the dip tube communicates directly with the blending space, the liquid tap orifice can be at the blending space end opening of the dip tube.

In the special case when a capillary dip tube is used, no liquid tap orifice as such is required. The capillary dip tube serves as the liquid tap orifice. However, the size parameters for the capillary dip tube and vapor tap orifice in that event are different, because of the unique flow restriction of the capillary dip tube, as noted previously.

The vapor tap orifice is in fluid flow connection with the propellant or gas phase of the aerosol container, and admits gas into the blending space before the valve stem delivery passage. Normally, therefore, it is in the wall means defining the blending space, and above the liquid tap orifice, although this is not essential. The vapor tap orifice can be in a wall beside or above the valve member, but it is of course upstream of the valve seat.

The valve delivery system of an aerosol container downstream of the valve normally includes an actuator which operates a delivery valve movable between open and closed positions, with a valve stem and an aerosol composition-conveying valve passage therethrough, in flow connection with a delivery port. The narrowest orifice in this delivery system is within the range from about 0.5 to about 0.65 mm in diameter.

Mixing of the gas and liquid phase occurs in the blending space, before these pass to the valve, and the diameters of the vapor tap and liquid tap orifices as well as the valve passage with which they are in communication are selected within the stated ranges to provide a gas: liquid volume ratio within the range from about 10:1 to about 40:1, and preferably from about 15:1 to about 30:1. It will be appreciated that for a given size of these openings, the gas:liquid ratio obtained from gas and liquid fed therethrough from the supply in the container will vary with the particular propellant or propellants and the composition of the liquid phase. The viscosity of the liquid is a factor in determining the proportion that can flow through the liquid tap orifice per unit time, when the valve is opened.

The orifice ranges given are applicable to all dispersion-type antiperspirant aerosol compositions. Other orifice ranges may be used with other types of aerosol compositions.

The gas-permeable membrane and any additional impedance means of the invention can be placed at any convenient location across the line of flow of liquefied propellant via the vapor tap orifice or orifices to the delivery port. Thus, they can be across the vapor tap orifice or orifices, for example, as a tubular sleeve enclosing the portion of the delivery valve or blending chamber housing pierced by the vapor tap orifice or orifices. They can also be disposed across the passage leading directly to the delivery port, downstream or upstream of the delivery valve, or across the blending space, or across a foam chamber, if there be one, or downstream of the vapor tap orifice, on the inside wall of the delivery valve or blending chamber.

A porous membrane so placed across the line of flow to the delivery port that not only propellant but also liquid aerosol composition being dispensed from the container must pass through the membrane must of course be wetted by and/or permeable to such aerosol composition. In this event, the membrane acts as a filter to remove suspended material larger than the pores through the membrane, and so the aerosol composition delivered will be a solution, or finely divided or colloidal dispersions. For such membranes, low bubble point membranes are desirable.

It is preferred that the gas-permeable membrane be impermeable to liquefied propellants. Impermeability requires that the membrane not be wetted by the liquefied propellant, and have an extemely small pore size, inasmuch as liquefied propellants have a rather low viscosity, and the internal gas pressures within the aerosol container are considerable. If the membrane is not wetted by the liquefied propellant, then the bubble point of the membrane is not critical.

If however the membrane is wetted by the liquefied propellant, and therefore the liquefied propellant can and does pass through the membrane, the bubble point of the membrane becomes important. A liquid-filled nondraining membrane is not permeable to gas unless the liquid can be blown out. The bubble point is that gas pressure differential across the membrane at which gas will blow through or out liquid filling the pores, and pass through the membrane.

It is essential to permit blow-out of nondraining liquid from pores of the membrane, when a container is restored to the upright position, and thus to permit passage of gas through the membrane in this position, that the bubble point of the membrane be less than the pressure differential across the membrane when the delivery valve is opened, at the internal gas pressure upstream of the membrane, when the container is in an upright position, during all stages of emptying the container, from full to the final delivery of aerosol composition before empty. In general, the membrane should therefore have a bubble point of less than one atmosphere. There is no critical lower limit; this can accordingly range as low as 0.03 atmosphere, and less, but the upper limit should not exceed about 2 atmospheres.

In general, aerosol containers pressurized with liquefied propellant will range in internal pressure from about 1.7 to about 4 atmospheres gauge at 21° C. The gauge pressure is the pressure differential between the pressure in the can and the atmosphere, and it is the pressure differential that is referred to with respect to the bubble point, as well as the rate of fluid flow.

The larger the pore size of the membrane, the lower the bubble point. However, the larger the pore size, the more rapid the rate of flow of liquefied propellant therethrough, and since the function of the membrane is to slow down the flow of liquefied propellant, the pore size of the membrane should not exceed about 25 microns, and preferably the pore size is within the range from about 0.2 micron to about 15 microns.

It is also important that the liquid-free, i.e., open pore, membrane not impede gas flow therethrough, since the gas flow is important, both in expelling the aerosol composition from the container, and in obtaining the desired ratio of gas:liquid in the delivery, particularly in the case where the aerosol container is to delivery the aerosol composition at a low delivery rate. Accordingly, the open area of the membrane is also important, and should be at least about 10%, and is preferably within the range from about 40 to about 90%. There is no critical upper limit on the open area, just as there is no critical upper limit on pore size of the membrane.

The surface area of the porous membrane should be sufficiently large to provide adequate gas flow even though it is partially covered by liquid, and it should not be so large as to permit liquid to flow through too rapidly. The required surface area will depend on the pressure differential across the membrane, and this in turn will depend on the vapor pressure differential across the membrane, and this in turn will depend on the vapor pressure of the liquefied propellant, the viscosity of the liquid phase, and all of the valve dimensions. This pressure differential cannot be measured conveniently. Instead, it is more practical to determine the required available surface area for the porous membrane by trial and error.

The porous membrane can be of any synthetic resinous or cellulose derivative material sheet that is inert to, i.e., is not dissolved or swelled excessively by, the aerosol composition in the container. Thus, polytetrafluoroethylene, ceramic, polyamide, polyisobutylene, polyvinylidene chloride, regenerated cellulose, polysulfone, polyacrylonitrile, polyester, polyethylene, polypropylene, synthetic rubber, cellulose acetate, and ethyl cellulose can be used. Also useful ar nonwoven fibrous mats of natural fibers such as cotton, wool, jute, ramie and linen, and/or of synthetic fibers such as any of the above synthetic resinous and cellulose derivative materials.

The impedance introduced by the membrane will of course depend upon the rate of flow of liquefied propellant through the membrane, which in turn is a function of the membrane characteristics, including pore size, wettability by the liquefied propellant, and percent open area. The impedance required can be obtained by providing a sufficient storage volume, or by providing a sufficient number of supplementary membrane stages, or both, as will be apparent from the preceding discussion.

The capacity of the impedance can be varied within wide limits. A convenient size provides a capacity of about 2.5 ml of liquid passing through the membrane; at a rate of liquid flow through the membrane not exceeding about 0.5 ml per second, at least 5 seconds is required to fill the impedance before spillover, an ample margin of safely, since a normal delivery lasts only 3 seconds.

A particularly useful porous membrane is a continuous mat of Teflon fibers bonded together at their crossing points and sold under the trademark MITEX LS, having a mean pore size of 5 microns, a bubble point in alcohol of 0.06 atmosphere, and, at a pressure differential of 0.92 atmosphere, a water flow rate of 70 ml/min/cm$^2$, and an air flow rate of 6000 ml/min/cm$^2$.

Assuming that a gas flow of about 5 to 10 ml/second at the internal pressure of the container at 21° C. is required for composition delivery, the available surface area of the membrane should be sufficient to provide a gas flow of about 40 ml/second.

At a pressure differential of 0.4 atmospheres and 1.08 cm$^2$ of surface area, and at 0.3 atmosphere and 1.43 cm$^2$ of surface area, a 1 cps liquid gives a flow rate of 0.5 ml/second. At a pressure differential of 0.92 atmosphere, and a surface area of 0.43 cm$^2$, liquid with a viscosity of 1.0 cps at 21° C. will flow through the membrane at a rate of 0.5 ml/second. Thus, a 2.5 ml volume impedance would not fill until after about 5 seconds.

The rate of liquid flow is inversely proportional to viscosity, and liquefied hydrocarbon propellants have on the average a viscosity of about 0.15 cps at 21° C. Liquefied propellant at this viscosity would fill a 2.5 ml impedance in less than one second. Hence, it would be necessary to increase the viscosity of the liquid phase to at least about 1 cps.

Another suitable fibrous membrane is Epoxy Versapor 6429, made of glass fibers bonded with epoxy resin, and having a mean pore size of 0.9 micron. At a pressure differential of 0.92 atmosphere, air flow is 16,000 ml/min/cm$^2$, and water flow is 70 ml/min/cm$^2$. The bubble point in kerosene is 0.2 atmosphere.

A membrane of the material having a surface area of 0.19 cm$^2$ gives a gas flow rate of 40 ml second at a pressure differential of 0.92 atmosphere. Liquid with a viscosity of 1.0 cps will flow through such a membrane at a rate of 0.22 ml/second. Thus, a 2.5 ml volume impedance would fill in about 11 seconds. A liquid viscosity of about 0.5 cps would fill in about 5 seconds.

At a pressure differential across the membrane of 0.4 atmosphere, 0.69 cm$^2$ of surface area gives a gas flow rate of 40 ml/second, and a 1 cps liquid flow rate of 0.33 ml/second. At a pressure differential of 0.3 atmosphere, and 1.38 cm$^2$ surface area, a 1 cps liquid gives a flow rate of 0.50 ml/second.

Another particularly useful membrane is DURALON NC, a polyamide sheet having a mean pore size of 14 microns, and a bubble point when wet with water of 0.17 atmosphere. At 0.92 atmosphere differential pressure, a 1020 ml/min/cm$^2$ flow rate for water and a 130,000 ml/min/cm$^2$ flow rate for air are observed. Those flow rates are substantially greater than those of the membrane above, and the surface area available can be reduced accordingly.

The above calculations are based on a liquid viscosity of 1 cps. If the viscosity were increased to 2 cps, liquid would flow at one-half the rate, and it would take twice as long to fill the holding device. However, it can be expected that the bubble point pressure would also be increased. Additionally and/or alternatively, the time required to fill the impedance can be increased by increasing the volume of the device.

If the liquid that is to pass through the membrane contains suspended material that is filtered out by the membrane, a pre-filter can be included upstream, to remove suspended material that might otherwise clog the membrane.

SUMMARY OF THE DRAWINGS

Preferred embodiments of aerosol containers in accordance with the invention are illustrated in the drawings, in which:

FIG. 11 is a detailed view showing the membrane and delivery valve portion of another embodiment of aerosol container in accordance with the invention, with the membrane across the line of flow of both propellant and aerosol composition to the delivery port; and FIG. 12 is a cross-sectional view taken along the line 12—12 of FIG. 11.

In principle, the preferred aerosol containers of the invention utilize a container having at least one compartment for propellant gas and liquid aerosol composition, communicated by at least one gas tap orifice and at least one liquid tap orifice to a blending space, which is across the line of flow to the valve delivery port. A liquid aerosol composition to be blended with propellant gas and then expelled from the container is placed in this compartment of the container, in flow communication via the liquid tap orifice with the blending space, so as to admit liquid aerosol composition into the blending space, while propellant gas flows into the blending space via the gas tap orifice or orifices to the valve.

The aerosol containers in accordance with the invention can be made of metal or plastic, the latter being preferred for corrosion resistance. However, plastic-coated metal containers can also be used, to reduce corrosion. Aluminum, anodized aluminum, coated aluminum, zinc-plated and cadmium-plated steel, tin, and acetal polymers such as Celcon or Delrin are suitable container materials.

The gas tap and liquid tap orifices can be disposed in any type of porous or foraminous structure. One each of a gas tap and liquid tap orifice through the compartment wall separating the propellant and any other compartments from the blending space will suffice. A plurality of gas tap and liquid tap orifices can be used, for more rapid blending and composition delivery, but the delivery rate of liquid will still be low, because of the high gas:liquid ratio. The total orifice open area is of course determinative, so that several large orifices can afford a similar delivery ratio to many small orifices. However, gas tap orifice size also affects blending, so that a plurality of small gas tap orifices may be preferable to several large orifices.

Orifices may also be provided on a member inserted in the wall or at one end of the wall separating the propellant and any other compartments from the blending space. One type of such member is a perforated or apertured plastic or metal plate or sheet.

The liquid tap orifice can be rather short or rather long, as in a passage through a tail piece member. While a capillary dip tube extending into the bottom of a layer or compartment for liquid aerosol composition is a kind of liquid tap orifice, different dimensions are applicable. The term "orifice" as used herein generically encompasses passages narrow enough to behave as orifices, regardless of length, in respect to liquid aerosol composition flowed therethrough.

The cross-sectional shape of the orifice is not critical. The orifices can be circular, elliptical, rectangular, polygonal, or any other irregular or regular shape in cross-section.

DESCRIPTION OF THE DRAWINGS

Figure 1:
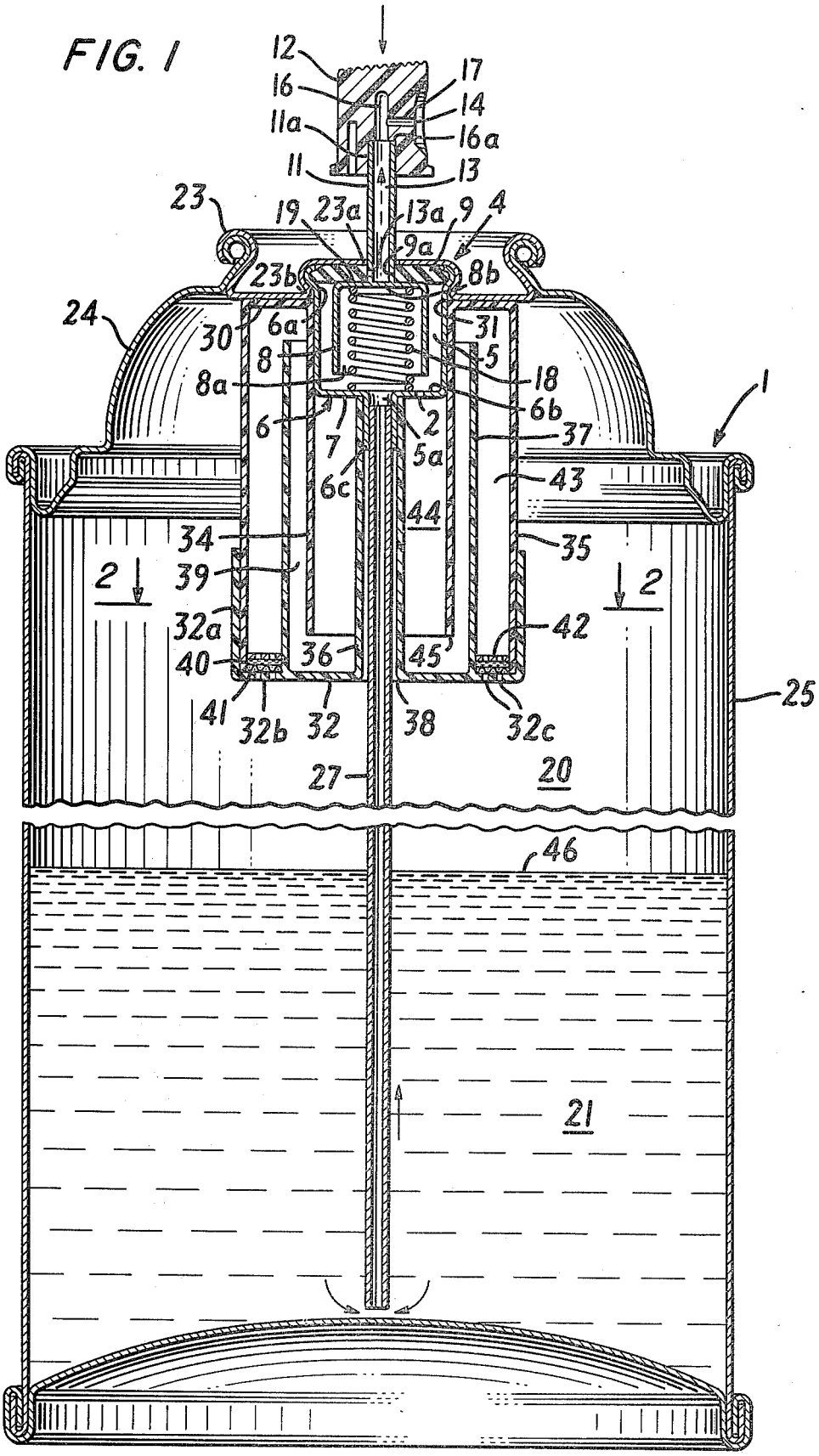
FIG. 1 represents a longitudinal sectional view of one embodiment of aerosol container in accordance with the invention, including a capillary dip tube in fluid flow connection with the vapor tap orifice; with a porous membrane in the form of an annular disc and impedance in the form of a storage chamber and overflow baffle system across the line of flow through the gas tap orifice to the delivery valve.
Figure 2:
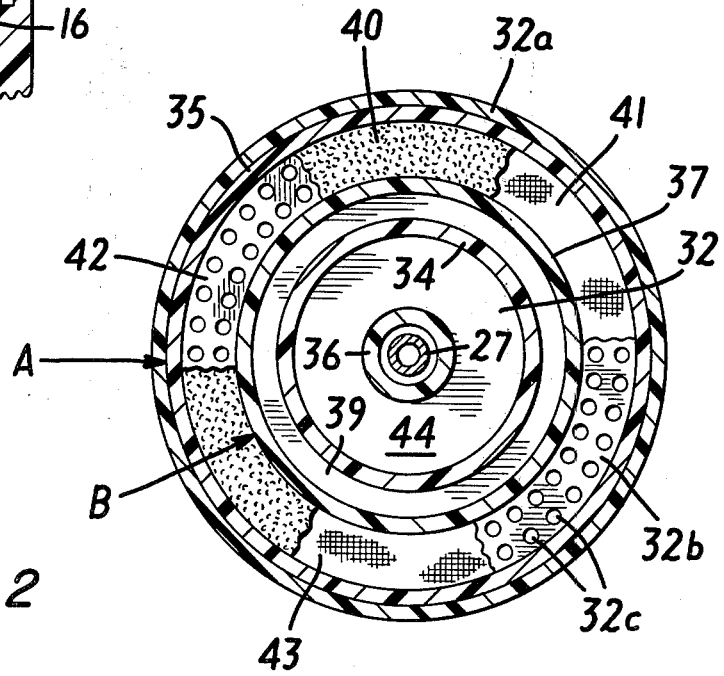
FIG. 2 represents a cross-sectional view taken along the line 2—2 of FIG. 1.

In the aerosol container 1 shown in FIGS. 1 and 2, the aerosol valve 4 is of conventional type, and comprises a delivery valve poppet 8 seating against the sealing face 19 of a sealing gasket 9 and integral with a valve stem 11. The valve stem is hollow, and has an axial flow passage 13 therethrough. The delivery valve poppet 8 is open at the inner end, defining a socket 8*a* therein, for the reception of a coil spring 18. The passage 13 is separated from the socket 8*a* within the poppet 8 by the divider wall 8*b*.

Adjacent the poppet wall 8*b* in a side wall of the stem 11 is a valve stem orifice 13*a*. The gasket 9 has a central opening 9*a* therethrough, which receives the valve stem 11 in a sliding leak-tight fit, permitting the stem to move easily in either direction through the opening, without leakage of propellant gas or liquid from the container. When the valve stem is in the outwardly extended position shown in FIG. 1, the surface of the poppet portion 8 contiguous with wall 8*b* is in sealing engagement with the inner face of the gasket 9, closing off the orifice 13*a* and the passage 13 to outward flow of the contents of the container.

The outer end portion 11*a* of the valve stem 11 is received in the axial socket 16 of the button actuator 12, the tip engaging the ledge 16*a* of the recess. The stem is attached to the actuator by a press fit. The axial socket 16 is in flow communication with a lateral passage 17, leading to the actuator (valve delivery) orifice 14 of the button 12.

A compression coil spring 18 has one end retained in the socket 8a of the valve popppet 8, and is based at its other end upon inner wall 6b of the valve housing 6. The spring 18 biases the poppet 8 towards the gasket 9, engaging it in a leak-tight seal at the valve seat 19. When the valve poppet is against the valve seat 19, the orifice 13a leading into the passage 13 of the valve stem is closed off.

The delivery valve is however reciprocably movable towards and away from the valve seat 19 by pressing inwardly on the button actuator 12, thus moving the valve stem 11 and with it poppet 8 against the spring 18. When the valve is moved far enough away from the seat 19, into the position shown in detail in FIG. 1A, the orifice 13a is brought beneath the valve gasket 9, and a flow passage is therefore open from the blending space 5 defined by the valve housing 6 to the delivery port 14. The limiting open position of the valve poppet 8 is fixed by the wall 6b of the housing 6, the valve poppet 8 encountering the housing wall, and stopped. The valve stem orifice 13a when in the open position communicates the stem passage 13 with the actuator passages 16, 17 and valve delivery orifice 14, and thus depressing the actuator 12 permits fluid flow via the space 5 to be dispensed from the container at delivery port 14.

Thus, the spring 18 ensures that the valve popped 8 and therefore valve 4 is normally in a closed position, and that the valve is open only when the button actuator 12 is moved manually against the force of the spring 18.

The valve housing 6 has an expanded portion 6a within which is received the sealing gasket 9 and retained in position at the upper end of the housing. The expanded portion 6a is retained by the crimp 23b in the center of the mounting cup 23, with the valve stem 11 extending through an aperture 23a in the cup. The cup 23 is attached to the container dome 24, which in turn is attached to the main container portion 25.

Through the bottom wall 7 of the valve housing 6 is a vapor tap orifice 2, which is in flow connection with the upper portion 20 of the space 21 within the container 1, and therefore with the gas phase of propellant, which rises into this portion of the container. The blending space 5 of the valve housing 6 terminates in a passage 5a, enclosed in the projection 6c of the housing 6. In the passage 5a is inserted one end of the capillary dip tube 27, which extends all the way to the bottom of the container, and thus dips into the liquid phase of the aerosol composition in portion 21 of the container. Liquid aerosol composition accordingly, enters the space 5 at the passage 5a, via the capillary dip tube 27, so that the dip tube serves as a long liquid tap orifice, while gas enters the space 5 through the gas tap orifice 2.

In the valve shown, the diameter of the actuator (valve delivery) orifice 14 is 0.5 mm, the valve stem orifice 13a is 0.5 mm, the diameter of the vapor tap orifice 2 is 0.76 mm and the inside diameter of the capillary dip tube 27 is 1.0 mm.

Figure 1A:
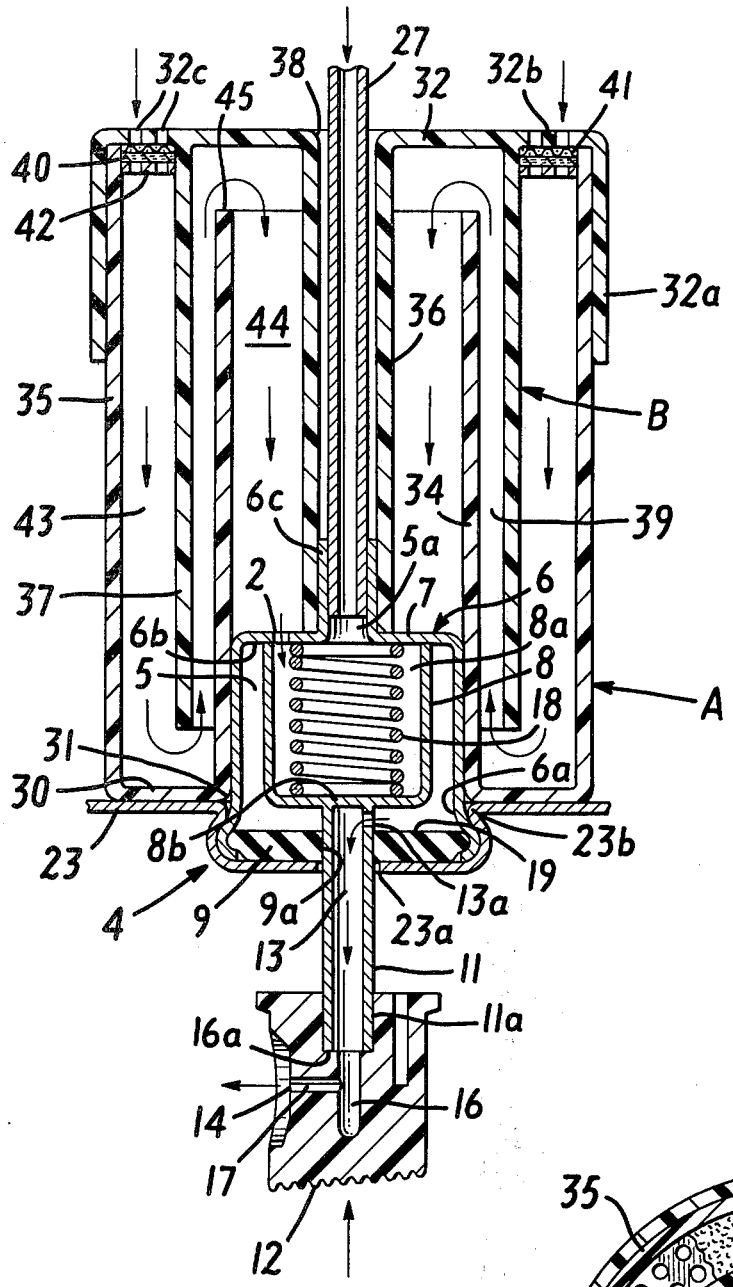
FIG. 1A represents a detailed view of the membrane and impedance of FIG. 1.

The membrane and impedance combination of the invention, best seen in FIG. 1A, is composed of two cylindrical interdigitated parts A and B, held together by end caps 30, 32. Part A comprises concentric inner cylinder 34, outer cylinder 35, and cap 30, all molded of a somewhat flexible plastic material such as polyethylene or polypropylene, the annular cap 30 having a central aperture 31 with a diameter equal to the inside diameter of the cylinder 34, and closing off the open end of spaces 39, 43 between the cylinders 34, 35. The diameter of cylinder 34 is slightly smaller than that of the valve housing 6, so that the valve housing can be inserted in a friction fit into aperture 31 of the cap 30. The cylinder 34 is somewhat shorter than cylinder 35.

Part B is also composed of concentric cylinders, an inner cylinder 36 and an outer cylinder 37 and a flanged gap 32, which extends across one end of cylinder 37, closing off the open ends of the spaces 39, 44 between the cylinders 36, 37. The cap has a central aperture 38 whose diameter is equal to the inside diameter of cylinder 36. One end of cylinder 36 fits over the projection 6c in a friction fit. The inside diameter of cylinder 37 is slightly larger than the outside diameter of cylinder 34, and the space defined between the two cylinders constitutes gas passage 39 in the assembled structure. The inside diameter of cylinder 35 is slightly less than the flange 32a, so that the cylinder 35 makes a friction fit with the cap 32. The end wall 32b of the cap has a plurality of openings 32c.

The wall 32b of cap 32 supports an annular disc 40 of porous membrane sheet, such as polyamide film, a prefilter 41 and a retaining perforated disc 42, which is held in place, confining the membrane and prefilter against the cap, at both its inner and outer periphery, by cylinders 35, 37. The components can also be bonded together.

Downstream of disc 42, defined by cylinders 35 and 37, is an impedance, a storage space 43 for liquid passing through the array of cap 32 (via orifices 32c), prefilter 41, membrane 40, and disc 42. When the container is inverted, it is readily seen in FIG. 1A that the only outlet from space 43 is via space 39, and over the end of cylinder 34, which does not reach cap 32, via annular weir 45, whence the liquid traverses space 44 between cylinders 34, 36, and enters the blending space 5 via vapor tap orifice 2.

In operation, button 12 is depressed, so that the valve stem 11 and with it valve poppet 8 and orifice 13a are manipulated to the open position, away from valve seat 19. Liquid aerosol composition is thereupon drawn up via the capillary dip tube 27 and passage 5a into the blending space 5, where it flows up around the poppet 8 towards the valve stem orifice 13a, while propellant gas passes through the vapor tap orifice 2, and is blended with the liquid aerosol composition in the space 5, entering from dip tube 27, as it flows around the poppet 8. The dimensions of the orifice 2, 27 are such that 18 volumes of gas enter through the vapor tap orifice 2 for each volume of liquid entering from the capillary dip tube 27.

The annular membrane and impedance combination are above the liquid level 46 in the container, when the container is upright as shown, and at least one portion is above liquid level even as the container is tipped towards the horizontal. Accordingly, the membrane has at least one portion liquid-free, and readily passes gas to the vapor tap orifice 2.

It will be apparent, however, that when the container is tipped, so that the valve 4 is below the horizontal, the cap 32 and membrane 40 dip below liquid level, so that all portions are immersed in liquid. Now liquid can pass through the membrane, and does. However, the liquid must fill spaces 43, 39 before it can overflow over weir 45 into and through space 44, and reach vapor tap orifice 2. This requires longer than the 3-second squirt time, and thus liquid does not have time to reach the delivery part of the system, which effectively prevents liquefied propellant from escaping from the container via the vapor tap orifice, even though the liquid propellant is now on the other side of the container. The dip tube 27 now taps the gas phase, and thus it is quite impossible for liquid propellant to escape from the container that way. Accordingly, a flammability hazard due to the escape of flammable liquid propellant is avoided.

Variations in this structure are apparent. Thus, membrane 40, prefilter 41 and support 42 can be assembled to the outside of cap 32, rather than to the inside, as shown. If the porous membrane can be heatsealed or cemented to the cap 32, and a prefilter is not needed, the membrane 40 and support 42 can be bonded together, and then bonded to the cap 32.

The available surface area of the porous membrane 40 can be limited by the number and size of the openings 32*c* in cap 32 (and disc 42, if present). Alternatively, part of the area can be closed off by filling in, or heat sealing.

To assemble the device, the porous membrane 40, prefilter 41 and support 42 are attached to cap 32. Parts A and B are interdigitatingly attached by the friction fit of flange 32*a* onto cylinder 35. The assembly is then friction-fitted onto the delivery valve housing, as shown in FIG. 1A. Cylinder 34 is friction-fitted to the housing 6, and cylinder 36 is friction-fitted to the projection 6*c*. The capillary dip tube 27 fits into the opening 5*a* and is attached to the valve 4 at the projection 6*c*, before attaching the membrane assembly. The capillary dip tube 27 passes through cylinder 36 to reach the opening 5*a*. In FIG. 1A, the arrows show the direction of gas liquid flow.

The following dimensions are suitable for a can with a 2.5 cm diameter opening, and an Aerosol Research PARC 39 valve. The valve body housing 6 has a diameter of 0.92 cm, while the reduced portion of the housing 6*c* will receive and provide a friction fit with a capillary dip tube 27 having an outside diameter of 0.25 cm.

All components have a wall thickness of 0.10 cm. Cap 30 and cylinder 35 have outside diameters of 2.1 cm. Cylinder 34 has an inside diameter of 0.84 cm; cylinder 37 has an inside diameter of 1.3 cm; cylinder 36 has an inside diameter of 0.38 cm; and both cap 32/flange 32*a* have an inside diameter of 2.0 cm. The corresponding inside lengths of the cylinders are 3.0 cm for cylinder 35, 2.7 cm for cylinders 34, 36 and 37, and 1.0 cm for flange 32*a*. A device of these dimensions has a chamber 43 whose capacity is in excess of 5 ml of liquid in any position, before liquid will overflow at 45 and pass through space 44 to the vapor tap orifice. The available surface area for the porous membrane is 1.0 $cm^2$.

This container is capable of delivering a dispersion type aerosol antiperspirant composition of conventional formulation at a delivery rate of about 0.4 g/second, about 40% of the normal delivery rate of 1 g/second. Accordingly, in order to obtain the same delivery of active ingredients (such as active antiperspirant) per squirt of a unit time, it is necessary to considerably increase the conentration of active antiperspirant composition. Normally, such compositions contain less than 5% active antiperspirant, because of clogging problems using standarized aerosol container valve systems and dimensions. In this container, however, it is possible to deliver at a low delivery rate about 0.3 to about 0.7 g/second of aerosol antiperspirant composition containing from about 8% to about 20% active ingredient as suspended or dispersed solid material without clogging, because of the high proportion of gas to liquid.

Figure 3:
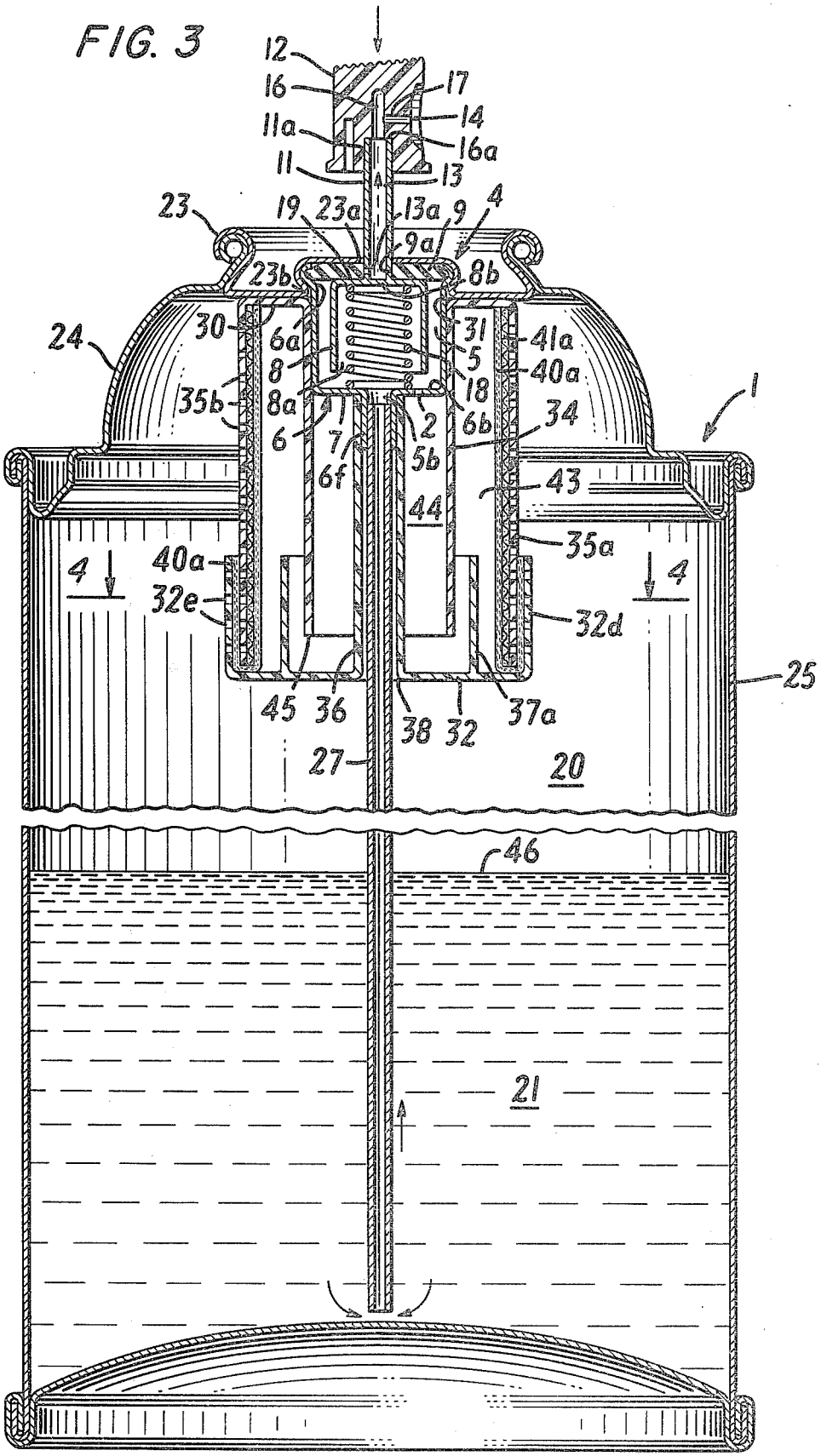
FIG. 3 represents a longitudinal sectional view of another embodiment of aerosol container in accordance with the invention, similar to that of FIGS. 1 and 2, including a tubular prefilter upstream of a tubular porous membrane.
Figure 3A:
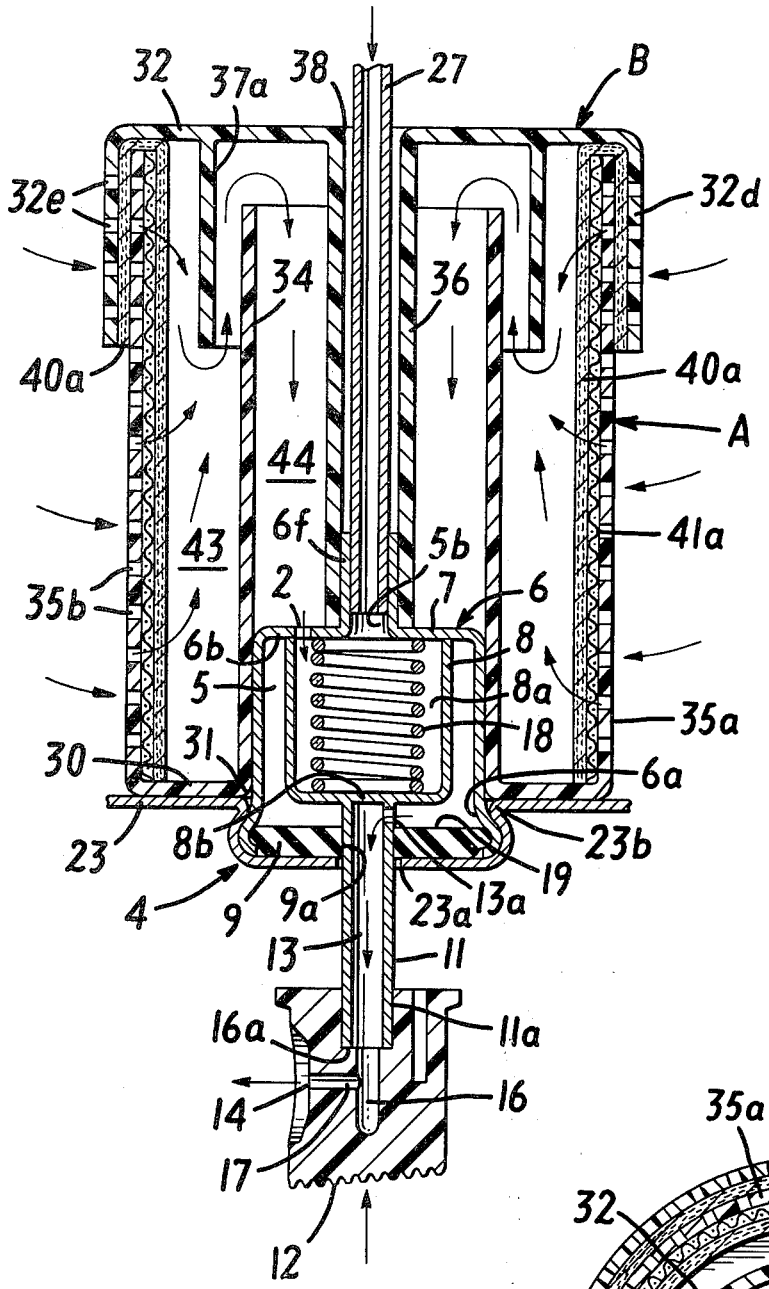
FIG. 3A represents a detailed view of the membrane and impedance of FIG. 3.
Figure 4:
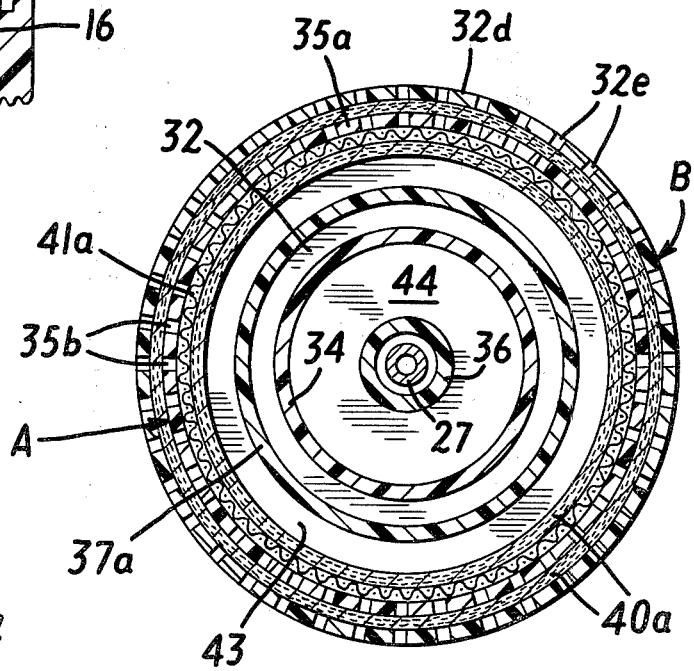
FIG. 4 represents a cross-sectional view taken along the line 4—4 of FIG. 3.

In the aerosol container shown in FIGS. 3 and 4, the disc membrane and prefilter are replaced by tubes of dimensions of cylinder 35. In other respects, the aerosol container is identical to that of FIGS. 1 and 2, and therefore like reference numerals are used for like parts.

In this container, the aerosol valve is of conventional type, as shown in FIGS. 1 and 2, with a valve stem 11 having a valve button 12 attached at one end, with valve button passages 16, 17 and a delivery orifice 14 therethrough, and a valve body 6 pinched by crimp 23*b* in the aerosol container cap 23. The valve body 6 has a blending space 5, which opens at the lower end into the restricted tail piece orifice 5*b*, constituting a liquid tap orifice, and at the other end, beyond the valve poppet 8, when the valve is open, into the valve stem orifice 13*a*. The valve poppet 8 is reciprocably mounted at one end of the valve stem 11, and is biased by the spring 18 against the valve seat 19 on the inside face of gasket 9 in the normally closed position. The valve is opened by depressing the button actuator 12. When the valve poppet 8 is away from its seat, the valve stem orifice 13*a* is in fluid flow communication with the blending space 5.

The valve housing 6 is provided with a vapor tap orifice 2, which puts the blending space 5 in flow connection with the gas or propellant phase in the space 20 at the upper portion of the aerosol container. The liquid aerosol composition is stored in the lower portion 21 of the container; and the dip tube 27 extends from the tail piece 6*f*, over which it is press-fitted in place, to the bottom of the container through the liquid phase, in flow connection with tail piece orifice 5*b*.

In this aerosol container, the diameter of actuator (valve delivery) orifice 14 is 0.5 mm; the diameter of the valve stem orifice 13*a* is 0.64 mm; the diameter of the vapor tap orifice 2 is 0.89 mm; and the diameter of the tail piece passage 5*b* is 0.76 mm.

The tubular form of the porous membrane and prefilter is desirable when a large available surface area for the porous membrane is required. In this case, the prefilter tube 41*a* and membrane tube 40*a* are concentric, the cap 32 is nonperforated, and the flange 32*d* and cylinder 35*a* are perforated, with openings 32*e*, 35*b*. The openings 32*e*, 35*b* therethrough are aligned when parts A and B are assembled. The tubular porous membrane 40*a*, confined between cylinder 35*a* and flange 32*d*, extends across the openings 32*e*, 35*b*, and can be cemented or sealed to flange 32*d*. The tubular prefilter 41*a* can also be cemented or heat-sealed into position. With this design, an available surface area for the porous membrane of 5 cm and more can readily be obtained.

Parts A and B would normally be molded with a slightly converging taper of perhaps 0.5° both to facilitate removal from the mold, and to improve the friction fit.

In operation, the button 12 is depressed, so that the valve poppet 8 and orifice 13*a* are manipulated to the open position. Liquid aerosol composition is drawn up by the dip tube 27 via the restricted tail piece orifice passage 5*b* into the blending space 5, where it is blended with propellant gas entering the space via the vapor tap orifice 2 from the propellant space 21 of the container. The blend, in a volume ratio gas: liquid of at least 8, is expelled under propellant gas pressure through the valve stem orifice 13*a*, leading the container via the stem passage 13, button passages 16, 17, and orifice 14 of the valve, as a fine spray.

It will be apparent that when the container is inverted the membrane 40*a* and prefilter 41*a* will be immersed in liquefied propellant, which can pass through, but must fill space 43 before it can overflow via weir 45 (which is protected by baffle 37*a* from surge flow) and reach the vapor tap orifice 2. This effectively prevents liquid propellant from escaping from the container via the vapor tap orifice, even though the liquid propellant is now on the other side of the container. The dip tube 27 now taps the gas phase, and thus it is quite impossible for liquid propellant to escape from the container. Accordingly, a flammability hazard due to the escape of flammable liquid propellant is avoided.

Figure 5:
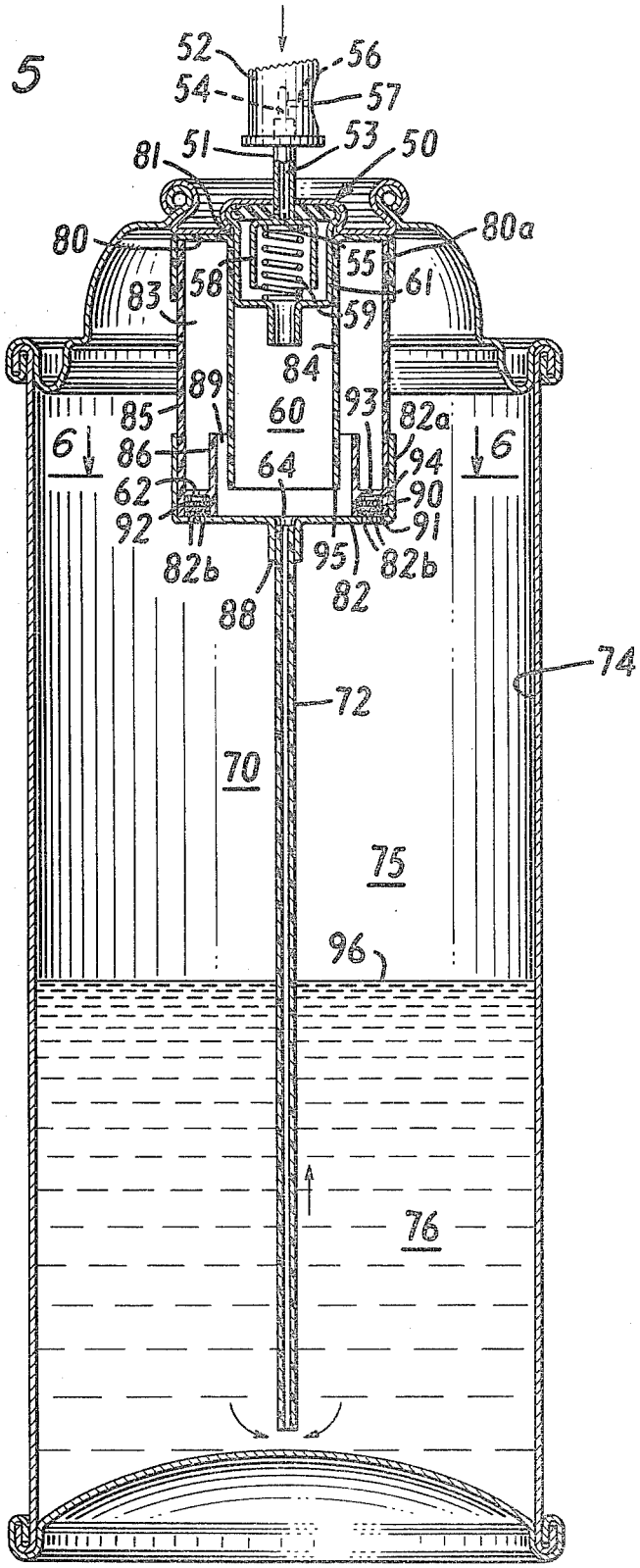
FIG. 5 represents a longitudinal sectional view of another embodiment of aerosol container in accordance with the invention, with a foam chamber.
Figure 6:
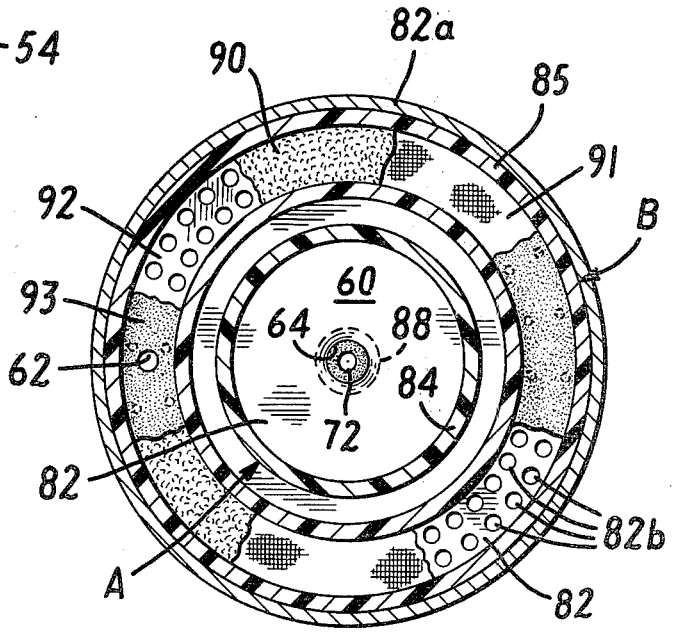
FIG. 6 represents a cross-sectional view taken along the line 6—6 of FIG. 5.

In the aerosol container shown in FIGS. 5 and 6, the aerosol delivery valve 50 is of conventional type, with a valve stem 51 having a valve button 52 attached at one end and a valve poppet 58 at the other end, biased by spring 59 into a closed position, and a flow passage 53 therethrough, in flow communication at one end via port 55 with the interior of a first foam compartment 60.

The valve passage 53 is open at the outer end at port 54 via button passage 56 to delivery port 57. The valve button 52 is manually moved against the coil spring 59 between open and closed positions. In the closed position, shown in FIG. 5, the valve port 55 is closed, the valve being seated against the valve seat. In the open position, shown in FIG. 5A, the valve stem is depressed by pushing in button 52, so that port 55 is exposed, and the contents of the foam compartment 60 are free to pass through the valve passage 53 and button passage 56 out the delivery port 57.

The remainder of the interior of the aerosol container outside the cylinder 85 and cap 82 of the foam compartment 60 thus constitutes the second annular propellant compartment 70 surrounding the first. The second compartment 70 contains liquefied propellant (such as a flammable hydrocabon, with a gas layer above that which fills head space 75) as part of the liquid layer 76 of aerosol composition. A dip tube 72 extends from the orifice 64 in foam compartment 60 to the bottom of the container propellant compartment 70. Through it, liquid aerosol composition enters the foam compartment 60 at orifice 64, when the valve 50 is opened, and forms a layer therein.

Figure 5A:
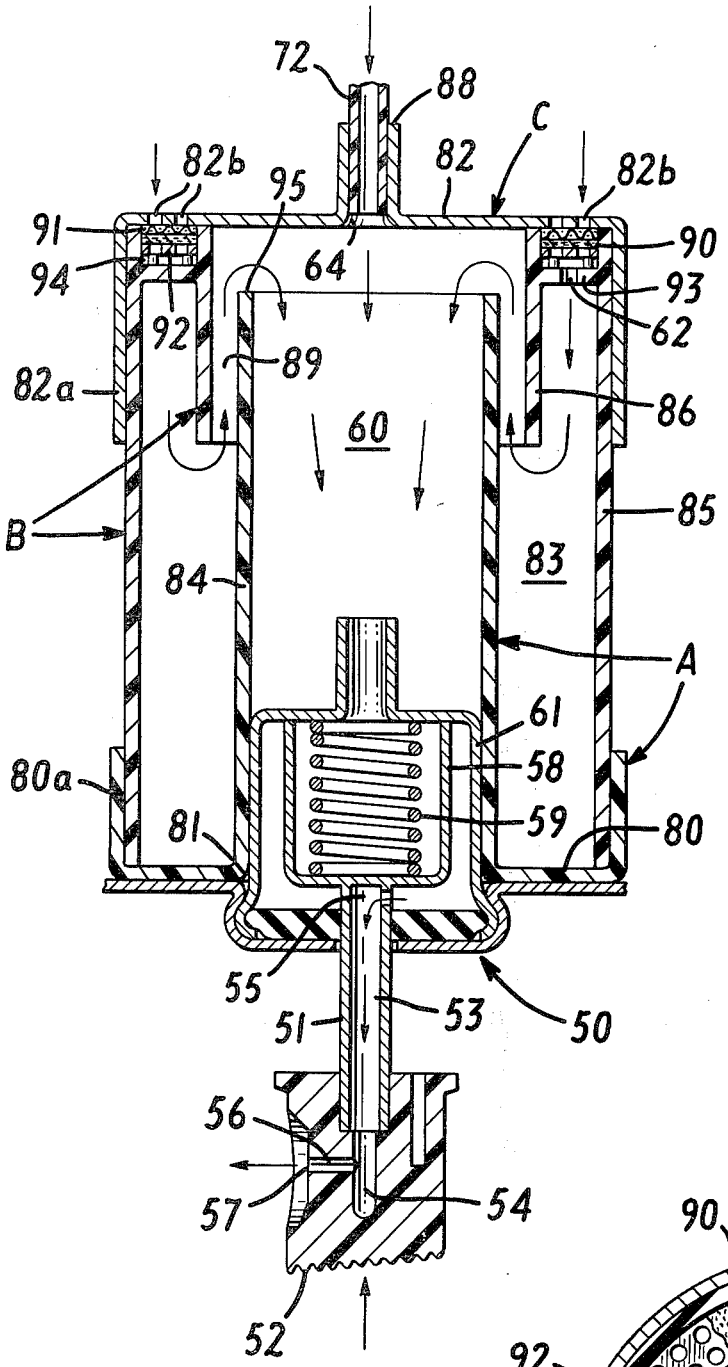
FIG. 5A is a detailed view showing the membrane and impedance of FIG. 5.

The membrane and impedance combination of the invention, best seen in FIG. 5A, is composed of two cylindrical interdigitated parts A and B, held together between flanged end caps 80, 82. Part A comprises inner cylinder 84, which defines the foam compartment 60 therewithin, and flanged cap 80, all molded of a somewhat flexible plastic material such as polyethylene or polypropylene. The cap 80 has a central aperture 81 with a diameter equal to the inside diameter of the cylinder 84, and a flange 80*a* embracing the end of cylinder 85 in a friction fit. The inside diameter of cylinder 84 is slightly smaller than that of the valve housing 61, so that the cylinder 84 can be inserted in a friction fit over the housing 61, and is held thereon.

Part B is composed of cap 82, which is friction-fitted over one end of concentric outer cylinder 85, and cylinder 85, bridge 93, and inner cylinder 86 are molded together in one piece. Bridge 93 contains the vapor tap orifice 62 for the foam compartment 60. Communication between orifice 62 and compartment 60 is via space 83, and the annular passage 89 between cylinders 84 and 86. The outside diameter of cylinder 85 is slightly less than the inside diameter of flanges 80*a*, 82*a*, so that the cylinder 85 is held therebetween in a friction fit.

The cap 82 has a projection 88 whose inside diameter matches the outside diameter of the capillary dip tube 72, and within which the dip tube is held in a friction fit. The cap 82 has a plurality of openings 82*b*.

Between the bridge 93 and the cap 82 are retained an annular disc 90 of porous membrane sheet, such as polyamide film, a prefilter 91, and a retaining perforated disc 92, which abuts the projections 94 on bridge 93. The projections 94 allow distribution of propellant gas from the porous membrane to gas orifice 62.

Downstream of bridge 93, the space 83 and annular passage 89 defined by cylinders 84, 85 and 86 constitute an impedance to flow of liquid passing through the array of cap 82, orifices 82*b*, prefilter 91, membrane 90, disc 92, and orifice 62. When the container is inverted, as is readily seen in FIG. 5A, the only outlet from space 83 is over the end of cylinder 84, which does not reach cap 82. The end of cylinder 84 thus inverted constitutes annular weir 95, whence the liquid enters the foam compartment 60.

The cylinder 86 constitutes a baffle that ensures that liquid passing through orifice 62 cannot enter the foam compartment 60 directly, but must first enter space 83, and execute two U-turns.

In operation, button 52 is depressed, so that the valve stem 51 and with it valve poppet 58 are manipulated to the open position, away from valve seat 55. Liquid aerosol composition is thereupon drawn up via the capillary dip tube 72 via orifice 64 into the foam compartment 60, while propellant gas passes via openings 82b in cap 82, membrane 90, prefilter 91, disc 92 and bridge 93, and space 83 through the annular vapor tap orifice 62, and is blended with the liquid aerosol composition in the compartment 60, entering from dip tube 72 via orifice 64. The dimensions of the orifice 62 are such that 18 volumes of gas enter through the vapor tap orifice 62 for each volume of liquid entering via liquid tap orifice 64 from the capillary dip tube 72.

The annular membrane and impedance combination are above the liquid level 96 in the container, when the container is upright as shown, and at least one portion is above liquid level even as the container is tipped towards the horizontal off the vapor tap orifice 62, when the valve 50 is in the uppermost position. Accordingly, the membrane 90 has at least one portion liquid-free, and readily passes gas to the vapor tap orifice 62.

It will be apparent, however, that when the container is tipped, so that the valve 50 is below the horizontal, the cap 82 and membrane 90 dip below liquid level, so that all portions are immersed in liquid. Now liquid can pass through the membrane, and does. However, the liquid must fill space 83 before it can overflow via passage 89 over weir 95 into compartment 60. This requires more time than the 3-second squirt time, and thus liquid does not have time to reach the delivery part of the system while the valve 50 is open, which effectively prevents liquefied propellant from escaping from the container via the vapor tap orifice, even though the liquid propellant is now on the other side of the container. The dip tube 72 now taps the gas phase, and thus it is quite impossible for liquid propellant to escape from the container that way. Accordingly, a flammability hazard due to the escape of flammable liquid propellant is avoided.

To assemble the device, support 92, membrane 90, and prefilter 91 are inserted, in that order, onto bridge 93, and then cap 82 is pressed in place over the cylinder 85, and attached thereto by the friction fit of the flange 82*a* on the cylinder. This completes part B. Then, parts A and B are interdigitatedly assembled by pressing cap 80 over the other end of cylinder 85, after which the assembly is pushed onto the valve housing 61 via the opening 81 in cap 80. The dip tube 72 is then friction fit into projection 88. The arrows in FIG. 5A show the direction of gas and liquid flow through the assembly as completed.

The available surface area of the porous membrane 90 can be limited by the number and size of the openings 82*b* in cap 82 (and disc 92, if present). Alternatively, part of the area can be closed off by filling in, or heat sealing.

The following dimensions are suitable for a can with a 2.5 cm diameter opening, and an Aerosol Research PARC 39 valve. The valve body housing 61 has a diameter of 0.92 cm. The projection 88 is tapered for ready insertion in a friction fit of a capillary dip tube whose outside diameter is 0.32 cm.

All components have a wall thickness of 0.10 cm. Cap 80 between flange 80*a* has an inside diameter of 2.2 cm, and cylinder 85 has an outside diameter of 2.1 cm. Cylinder 84 has an inside diameter of 0.84 cm; cylinder 85 has an inside diameter of 1.9 cm; and flange 82*a* has an inside diameter of 2.0 cm. The corresponding inside lengths of the cylinders are 3.0 cm for cylinder 85, 2.7 cm for cylinder 84, and 1.0 cm for cylinders 86 and 88, and flanges 80*a* and 82*a*.

A device of these dimensions has a space 83 whose capacity is in excess of 5 ml of liquid in any position, before liquid will overflow through passage 89 over weir 95 and pass into chamber 60. The available surface area for the porous membrane is 3 $cm^2$.

This container is capable of delivering a dispersion type aerosol antiperspirant composition of conventional formulation at a delivery rate of about 0.4 g/second, about 40% of the normal delivery rate of 1 g/second. Accordingly, in order to obtain the same delivery of active ingredients (such as active antiperspirant) per squirt of a unit time, it is necessary to considerably increase the concentration of active antiperspirant composition. Normally, such compositions contain less than 5% active antiperspirant, because of clogging problems using standardized aerosol container valve systems and dimensions. In this container, however, it is possible to deliver at a low delivery rate about 0.3 to about 0.7 g/second of aerosol antiperspirant composition containing from about 8% to about 20% active ingredient as suspended or dispersed solid material without clogging, because of the high proportion of gas to liquid.

Figure 7:
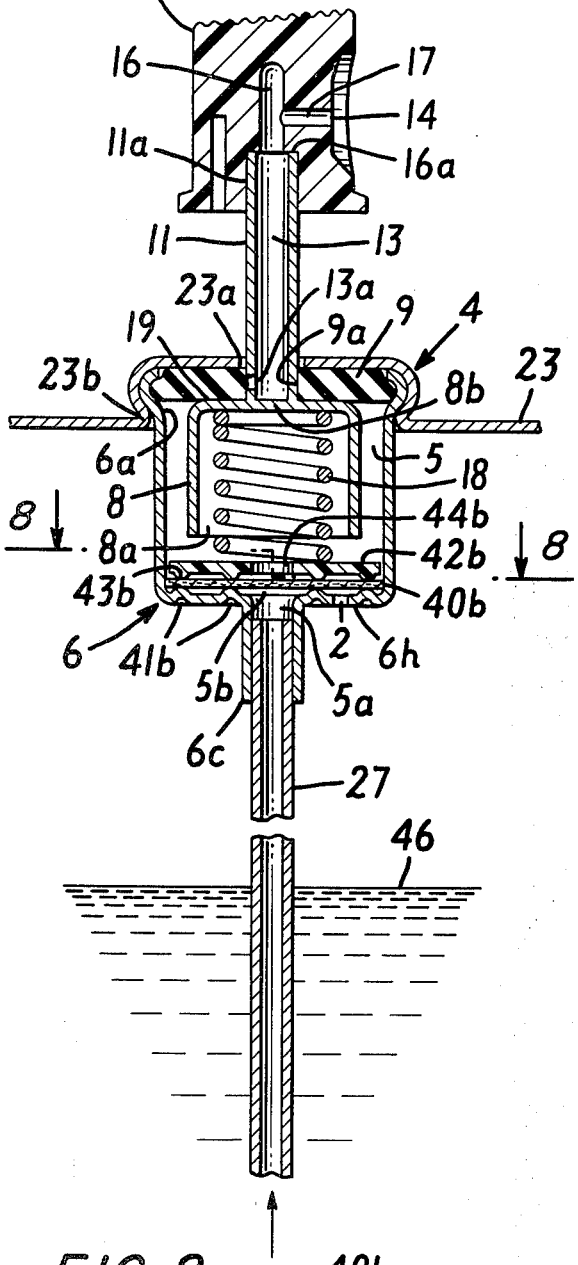
FIG. 7 is a detailed view showing the membrane and delivery valve portion of another embodiment of aerosol container in accordance with the invention, with the membrane across the line of flow of both propellant and aerosol composition to the delivery port.
Figure 8:
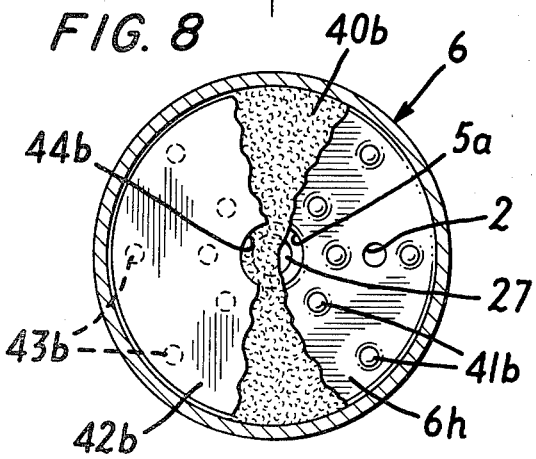
FIG. 8 is a cross-sectional view taken along the line 8—8 of FIG. 7.

FIGS. 7 and 8 show the aerosol valve and membrane construction of another embodiment of the invention, the aerosol container being otherwise identical to that shown in FIGS. 1 and 2, and therefore not shown in these Figures. The aerosol valve is similar in construction to that of FIGS. 1 and 2, and consequently like reference numerals are used for like parts.

In this case, the porous membrane 40*b* is fitted in the delivery valve housing 6, across the line of flow both of propellant fluid and of aerosol composition entering the valve chamber 5 either through the vapor tap orifice 2, or through the dip tube 27 at inlet 5*a*, in any orientation of the container.

In this embodiment, the valve chamber housing wall 6*h*, the gas tap orifice 2 in this housing wall, and the inlet 5*a* in the projection 6*c* of the housing 6 are all covered over by the porous membrane sheet 40*b*, which extends all the way across and closes off the lower portion 5*b* of the chamber 5, coextensive with the wall 6*h*. The membrane is held spaced from the wall 6*h* by the wall projections 41*b*. If the wall 6*h* is of plastic, these can be molded as a part of the wall. With the membrane in this position, all propellant fluid, both gas and liquid, and all liquid aerosol composition entering the chamber 5*b* via the vapor tap orifice 2, and/or via the inlet 5*a* from the dip tube 27, must pass through the membrane 40*b* before they can reach chamber 5 and outlet port 14.

This may subject the membrane to considerable differential fluid pressure, when the valve 4 is open, and consequently a rigid plastic disc 42*b* is provided, above (i.e., downstream of) the membrane. The disc 42*b* is molded with a plurality of projections 43*b*, which serve to space the membrane from the surface of the disc. Thus, fluid can distribute itself across the entire surface area of the porous membrane 40*b*, on either side thereof.

To retain the membrane 40*b* and disc 42*b* in the position shown, the disc 42*b* can be bonded to the side walls of the valve housing 6. The disc can also be retained in the position shown by the spring 18.

The disc 42*b* has an orifice 44*b*, for flow of fluid passing through the membrane 40*b* into the open space beyond the chamber 5. When the valve 4 is open, the fluid can proceed via the orifice 13*a* through the valve stem passages 13, 16, 17 to the delivery port 14, in the valve button 12.

In normal operation, with the container upright, button 12 is depressed so that the valve stem 11 and with it valve poppet 8 and orifice 13*a* are manipulated to the open position, with the valve away from the valve seat 19, exposing orifice 13*a*. Liquid aerosol composition is thereupon drawn up via the capillary dip tube 27 and the passage 5*a* into the lower portion 5*b* of chamber 5, whence it flows through the porous membrane 40*b*, past the disc 42*b*, via the opening 44*b*, into chamber 5. Propellant gas passes through the vapor tap orifice 2 into portion 5*b*, where it is blended with the liquid aerosol composition, and then after passage through the porous membrane 40*b* enters into the space 5 where blending of gas and liquid is completed. The blend flows around the poppet 8, and is then discharged at outlet 14 via orifice 13*a* and passages 13, 16, 17. The dimensions of the orifices 2, 27 are such that eight or more volumes of gas enter through the vapor tap orifice 2 for each volume of liquid entering from the capillary dip tube 27.

The valve housing 6 and therefore the vapor tap orifice 2 are above the liquid level 46 in the container (see also FIGS. 1 and 2) when the container is upright, as shown, and the vapor tap orifice 2 is above the liquid level even as the container is tipped towards the horizontal, while the valve 4 is above the horizontal, in the uppermost position. Accordingly, the membrane readily passes gas as well as liquid from the blending space 5*b* into blending space 5.

It will be apparent, however, that when the container is tipped so that the valve 4 is below the horizontal, the vapor tap orifice 2 eventually dips below liquid level, so that liquid propellant can pass through the vapor tap orifice 2 into the space 5*b*, below the porous membrane. Simultaneously, the dip tube extends into the gas phase so that propellant gas as well as aerosol composition pass through the porous membrane. The sizes of the vapor tap and liquid tap orifices are selected, in accordance with the characteristics of the porous membrane and the aerosol composition, to provide a volume ratio of gas: liquid passing through the membrane of at least about 8:1, regardless of the orientation of the container.

In this container, an Aerosol Research PARC 39 valve has been modified by the introduction of membrane 40b and disc 42b in the body housing 6, and by shortening the ferrule 8 and spring 18 to compensate for the thickness of the membrane and disc. A 7.8 mm diameter membrane fits snugly in the body housing of this valve. The membrane is Versapor 6429, 0.9 micron mean pore size (Gelman Instrument Company). The vapor tap orifice 2 is 0.64 mm in diameter, the capillary dip tube 27 has an inside diameter of 1.0 mm, and the valve stem orifice 13a is 0.50 mm in diameter.

With a 0.38 mm diameter orifice in a two piece mechanical breakup button 12, and a composition comprising an alcoholic solution pressurized with a 20:80 weight ratio of propane: isobutane, product is expelled at a rate of 0.3 g per second, and the flame projection is zero, regardless of whether the container is positioned with the valve above or below the horizontal. The spray may be wet or dry depending on the ratio of alcoholic solution to propellant used in the composition. A wet spray is required for a hair spray, while a dry spray is preferable for an underarm deodorant.

If the button 12 is replaced by a one piece non-breakup button with a 0.38 mm diameter orifice, product is expelled at a rate of 0.4 g per second. The flame projection is 12 cm when the container is positioned with the valve above the horizontal, and zero when the valve is below the horizontal.

This container is intended for use with solution compositions that do not contain dispersed solids, since such solids will be filtered out by the membrane. If the solids are sufficiently small, they may plug the pores. Typically, the container would be used with colognes, hair sprays, and solution-type deodorants and antiperspirants. These products generally comprise alcoholic solutions of active ingredients pressurized with liquefied propellants.

Figure 9:
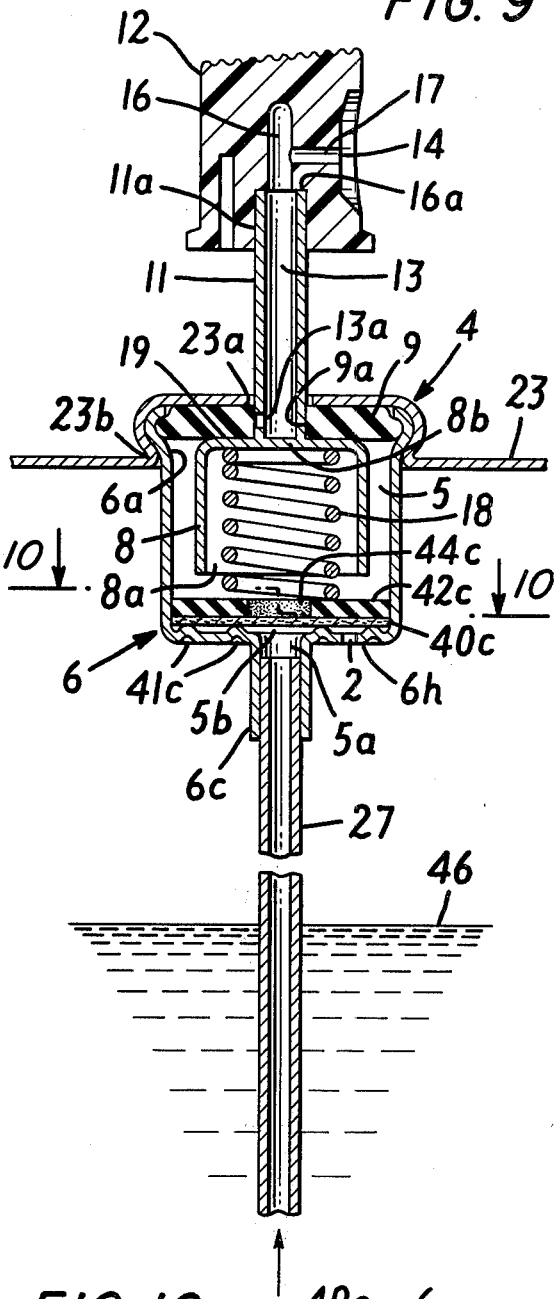
FIG. 9 is a detailed view showing the membrane and delivery valve portion of another embodiment of aerosol container in accordance with the invention, with the membrane across the line of flow of both propellant and aerosol composition to the delivery port.
Figure 10:
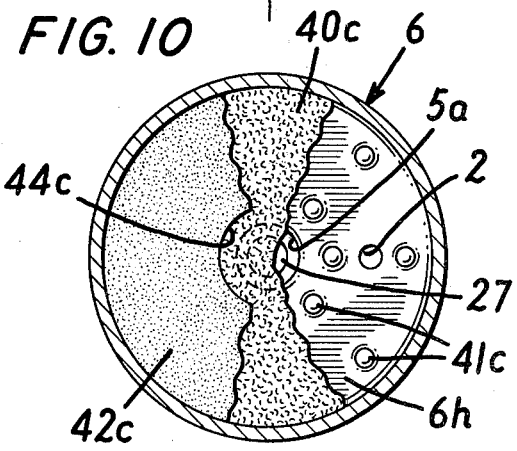
FIG. 10 is a cross-sectional view taken along the line 10—10 of FIG. 9.

FIGS. 9 and 10 show the aerosol valve and membrane construction of another embodiment of the invention, the aerosol container being otherwise identical to that shown in FIGS. 1 and 2, and therefore not shown in these Figures. The aerosol valve is similar in construction to that of FIGS. 1 and 2, and consequently like reference numerals are used for like parts.

As in the case of FIGS. 7 and 8, the porous membrane is fitted in the delivery valve housing 6 across the line of flow both of propellant fluid through the vapor tap orifice 2 and of aerosol composition entering at the inlet 5a through the dip tube 27.

In this embodiment, the valve chamber housing wall 6h, the gas tap orifice 2 in this housing wall, and the passage 5a in the projection 6c of the housing 6, are all covered over by a porous membrane sheet 40c, which extends all the way across and closes off the lower portion 5b of the chamber 5 of the valve housing 6, coextensive with the wall 6h. The membrane is held spaced from the wall 6h by the projections 41c, which are a part of wall 6h. With the membrane in this position, all propellant, both gas and liquid, and all liquid aerosol composition entering the space 5b via the dip tube 27 and the passage 5a and/or via the vapor tap orifice must pass through the membrane 40c before they can reach the chamber 5 and outlet port 14.

This may subject the membrane to considerable differential fluid pressure when the valve 4 is open, and consequently a rigid rubber gasket 42c having a central aperture 44c is provided above (i.e., downstream of) the membrane. The gasket 42c is pressed against the membrane 40c, limiting the area of the membrane through which fluid can pass to the portion of the membrane directly below orifice 44c in gasket 42c. Thus, fluid can pass through only that portion of the surface area of the porous membrane 40c opposite aperture 44c of the gasket 42c.

The gasket 42c and membrane 40c are retained in the position shown by the spring 18. The aperture 44c allows fluid passing through the membrane 40c to flow into the open space of the chamber 5. When the valve 4 is open, the fluid can proceed from chamber 5 via the orifice 13a through the valve stem passages 13, 16, 17 to the delivery port 14, in the valve button 12.

In operation, button 12 is depressed so that the valve stem 11 and with it valve poppet 8 and orifice 13a are manipulated to the open position, with the valve away from the valve seat 19. Liquid aerosol composition is thereupon drawn up via the capillary dip tube 27 and the inlet 5a into the blending space 5b, where it flows through the porous membrane 40c and the opening 44c in gasket 42c, while propellant gas passes through the vapor tap orifice 2 and is blended with the liquid aerosol composition in the space 5b before and in chamber 5 after passage through the porous membrane 40c. The blend flows around the poppet 8, and then through orifice 13a and passages 13, 16, 17 to the discharge orifice 14. The dimensions of the orifices 2, 27 are such that at least eight volumes of gas enter through the vapor tap orifice 2 for each volume of liquid entering from the capillary dip tube 27.

The valve housing 6 and therefore the vapor tap orifice 2 are above the liquid level 46 in the container (see also FIGS. 1 and 2) when the container is upright, as shown, and the vapor tap orifice 2 is above the liquid level even as the container is tipped towards the horizontal while the valve 4 is in the uppermost position. Accordingly, the membrane 40c readily passes gas as well as liquid into the blending space 5.

It will be apparent however that when the container is tipped so that the valve 4 is below the horizontal, the vapor tap orifice 2 eventually dips below the liquid level, so that liquid propellant can pass through the vapor tap orifice 2 into the space 5b below the porous membrane. Simultaneously, the dip tube extends into the gaseous phase so that gaseous propellant as well as liquid composition pass through the porous membrane. The sizes of the vapor tap and liquid tap orifices are selected, in accordance with the characteristics of the porous membrane and the aerosol composition, to provide a volume ratio of gas: liquid passing through the membrane of at least about 8:1, regardless of the orientation of the container.

In this container, an Aerosol Research PARC 39 valve has been modified by the introduction of membrane 40c and gasket 42c in the body housing 6, and by shortening the ferrule 8 and spring 18 to compensate for the thickness of the membrane and disc. A 7.8 mm diameter membrane fits snugly in the body housing of this valve. The membrane is Versapor 6429, 0.9 micron mean pore size (Gelman Instrument Company). The gasket orifice 44c is 2.5 mm in diameter. The vapor tap orifice 2 is 0.64 mm in diameter, the capillary dip tube 27 has an inside diameter of 1.0 mm, and the valve stem orifice 13a is 0.50 mm in diameter.

With a 0.38 mm diameter orifice in a two piece mechanical breakup button 12, and a composition comprising an alcoholic solution pressurized with a 20:80 weight ratio of propane: isobutane, product is expelled at a rate of 0.1 gram per second, and the flame projection is zero, regardless of whether the container is oriented with the valve above or below the horizontal. This container can give very small delivery rates and is suitable for such product applications as lecithin pan coatings, food flavors, and breath fresheners.

FIGS. 11 and 12 show another embodiment of aerosol valve and membrane constuction of the invention in which the aerosol container is identical to that shown in FIGS. 1 and 2 and therefore is not shown. The aerosol valve is similar in construction to that of FIGS. 1 and 2, and consequently like reference numerals are used for like parts.

In this case, the porous membrane **40*d* is fitted in a separate housing 40*h* downstream of the delivery valve housing 6, across the line of flow of propellant and aerosol composition entering the housing 40*h* through the dip tube 27, en route to the delivery port 14**.

In this embodiment, the housing **40*h* is in two portions, 40*i* and 40*ii*, and the outer periphery of the porous membrane sheet 40*d*, which extends all the way across the chamber 40*c* of the housing 40*h*, is held in the bite 40*iii* of the two housing portions. If desired, foraminous supports can be placed in juxtaposition to the membrane, on each side. With the membrane in this position, all propellant fluid, and all liquid aerosol composition entering the chamber 40*c* of housing 40*h* from the dip tube 27 must pass through the membrane 40*d* before they can reach the valve chamber 5 and outlet port 14**.

The housing portions **40*i*, 40*ii* can be bonded together or press fit, thereby retaining the membrane 40*d*** in the position shown.

The housing portion **40*i* has a projection 40*m* which receives the projection 6*k* of valve housing 6, with a central passage 5*f* therethrough. The housing portion 40*ii* has a like projection 40*n* receiving dip tube 27**.

In operation, button 12 is depressed, so that the valve stem 11 and with it valve poppet 8 and orifice **13*a* are manipulated to the open position, with the valve away from the valve seat 19. Liquid propellant and aerosol composition are thereupon drawn up via the capillary dip tube 27 into the chamber 40*e*, where they flow through the porous membrane 40*d* and then enter the passage 5*f*, and pass into the chamber 5. The volume ratio of propellant gas: liquid composition passing through the membrane 40*d* is at least 8:1 to provide a nonflammable spray. The blend flows around the poppet 8, and then via orifice 13*a*, and passages 13, 16, 17 to delivery port 14**.

It will be apparent that in any orientation of the container, liquid propellant can pass through the porous membrane **40*d*. However, the membrane because of the small pore openings considerably slows the rate of flow of liquid aerosol composition including liquid propellant downstream into the blanding space 5. This restraint to liquid flow makes it possible to readily select vapor tap and liquid tap orifice sizes to provide at least an 8:1 volume ratio of gas to liquid composition passing through membrane 40*d*,** regardless of the orientation of the container. Accordingly, a flammability hazard is avoided.

With this container, the size of the membrane is not limited by the dimensions of the valve body housing. The housing portions **40*i* and 40*ii* can be made larger than the body housing 6, with the size of the membrane 40*d*** corresponding.

The following membrane and dimensions are suitable. The membrane is Versapor 6429, 0.9 micron mean pore size, 8 mm diameter. The vapor tap orifice **2*a* is 0.64 mm in diameter, the capillary dip tube 27 has an inside diameter of 1.0 mm, and the valve stem orifice 13*a* is 0.64 mm in diameter. Button 12** is a two piece non-mechanical break-up actuator with an orifice diameter of 0.46 mm. A composition comprising 55% by weight of an alcoholic hair spray solution, 9% by weight propane, and 36% by weight isobutane was expelled at a rate of 0.35 gram per second. The flame projection was 12 cm at any orientation of the container.

The aerosol containers of the instant invention can be used to deliver any aerosol composition at a low delivery rate of active ingredient in the form of a spray. The range of products that can be dispensed by this aerosol container is diverse, and includes pharmaceuticals for spraying directly into oral, nasal and vaginal passages; antiperspirants, hair sprays, fragrances and flavors; body oils; insecticides; window cleaners and other cleaners; spray starches; and polishes for autos, furniture and shoes, and deodorants.

Having regard to the foregoing disclosure, the following is claimed as the inventive and patentable embodiments thereof:

1. An aerosol container for use with compositions containing liquefied flammable propellants, and having a gas-permeable membrane that is at best only slowly permeable by liquefied propellants, and impeding liquid flow via a gas tap orifice through an open manually-operated delivery valve, at least when the container is tipped from the upright position beyond the horizontal towards the fully inverted position, the container comprising, in combination, a pressurizable container having at least one storage compartment for an aerosol composition and a liquefied propellant in which compartment propellant can assume an orientation according to orientation of the container between a horizontal and an upright position, and a horizontal and an inverted position; a delivery valve movable manually between open and closed positions, and including a valve stem and a delivery port; an aerosol-conveying passage in flow connection at one end with the storage compartment and at the other end with the delivery port, manipulation of the delivery valve opening and closing the passage to flow of aerosol composition and propellant from the storage compartment to the delivery port; a gas tap orifice in flow connection on one side with the storage compartment and on the other side with the delivery port; and a gas-permeable membrane that is at best only slowly permeable by liquefied propellants, disposed across the gas tap orifice in the line of flow of liquefied propellant from the storage compartment to the delivery port, and impeding flow of liquefied propellant to the delivery port, at least in an orientation of the container between the horizontal and an inverted position.

2. An aerosol container according to claim 1, comprising an impedance across the line of flow between the delivery port and the storage compartment, further delaying flow of the liquefied propellant to the delivery port.

3. An aerosol container according to claim 2 in which the impedance is upstream of the membrane, in the line of flow.

4. An aerosol container according to claim 3 in which the impedance is downstream of the membrane, in the line of flow.

5. An aerosol container according to claim 2, in which the impedance includes a storage chamber for collecting liquid and a weir operative in such container orientation to allow overflow of liquid from the chamber, for flow to the delivery port.

6. An aerosol container according to claim 5, comprising a tubular enclosure of the storage chamber, the membrane comprising at least part of one wall of the enclosure.

7. An aerosol container according to claim 6 in which the enclosure is a cylinder whose open ends are closed off by caps, at least one cap is apertured, and the membrane is placed across the apertures in a manner such that all flow through the apertures must pass through the membrane.

8. An aerosol container according to claim 2, in which the delivery valve includes a chamber housing receiving one end of a dip tube and the gas tap orifice is disposed in a wall of the chamber.

9. An aerosol container according to claim 1 comprising a prefilter upstream of the membrane in the line of flow to the gas tap orifice.

10. An aerosol container according to claim 9 in which the prefilter and membrane are juxtaposed in an array comprising a foraminous support downstream of the membrane in the line of flow to the gas tap orifice.

11. An aerosol container according to claim 1 in which the gas-permeable membrane is impermeable to liquefied propellants.

12. An aerosol container for delivering liquid aerosol compositions highly concentrated with respect to the active ingredient at a low delivery rate, comprising, in combination, a pressurizable container having a delivery valve movable between open and closed positions, a valve stem, and a delivery port; a valve stem orifice in the valve stem in flow connection at one end with a blending space and at the other end with an aerosol-conveying valve stem passage leading to the delivery port; the valve stem orifice having a diameter within the range from about 0.33 to about 0.65 mm; bias means for holding the valve in a closed position; means for manipulating the valve against the bias means to an open position for expulsion of aerosol composition via the valve stem orifice to the delivery port; wall means defining the blending space and separating the blending space from liquid aerosol composition and propellant within the container, at least one liquid tap orifice through the wall means, having a cross-sectional open area within the range from about 0.2 and 0.8 $mm^2$ for flow of liquid aerosol composition into the blending space; at least one vapor tap orifice through the wall means, having a cross-sectinal open area within the range from about 0.2 to about 0.8 $mm^2$ for flow of propellant into the blending space; the ratio of liquid tap orifice to vapor tap orifice cross-sectional open area being within the range from about 0.5 to about 2.5; the open areas of the liquid tap orifice and vapor tap orifice being selected within the stated ranges to provide a volume ratio of propellant:gas liquid aerosol composition within the range from about 8:1 to about 40:1, thereby limiting the delivery rate of liquid aerosol composition and propel any gas from the container when the delivery valve is opened; and a gas-permeable membrane that is at best only slowly permeable by liquefied propellants, disposed across the line of flow of liquefied propellant from the storage compartment to the delivery port, and impeding liquid flow via a gas tap orifice through an open manually-operated delivery valve, at least when the container is tipped from the upright position beyond the horizontal towards the fully inverted position.

13. An aerosol container according to claim 12, in which the liquid tap orifice is a capillary dip tube whose cross-sectional open area is within the range from about 0.2 to about 1.8 $mm^2$, for flow of liquid aerosol composition into the blending space; the vapor tap orifice through the wall means has a cross-sectional open area within the range from about 0.2 to about 0.8 $mm^2$ for flow of propellant gas into the blending space; and the ratio of capillary dip tube to vapor tap cross-sectional open area is within the range from about 1.0 to about 3.2.

14. An aerosol container according to claim 12, in which the blending space has a volume of from about 0.1 to about 1 cc.

15. An aerosol container according to claim 12, having a single gas tap orifice and a single liquid tap orifice.

16. An aerosol container according to claim 12, having a tail piece pasage as the liquid tap orifice.

17. An aerosol container according to claim 12 in which the container is cylindrical, with the delivery valve at one end, the wall means defining the blending space comprises a concentric inner cylinder spaced from the walls of the container surrounding and housing the delivery valve; the gas tap orifice is through a wall of the inner cylinder; the liquid tap orifice is through a wall of inner cylinder; a concentric outer cylinder spaced from the inner cylinder and defining therewith a storage space for collection of liquefied propellant, the membrane controlling flow into said space, and the remainder of the interior of the aerosol container outside the walls and bottom of the outer cylinder comprises an annular outer compartment for propellant gas and liquid aerosol composition.

18. An aerosol container according to claim 17, having a plurality of gas tap orifices through a side wall of the inner cylinder.

19. An aerosol container according to claim 17, comprising a separate compartment for liquid aerosol composition and for propellant, each in direct flow connection with the blending space via the liquid tap and gas tap orifice, respectively.

20. An aerosol container according to claim 17, in which the liquid tap orifice is a capillary dip tube whose cross-sectional open area is within the range from about 0.2 to about 1.8 $mm^2$, for flow of liquid aerosol composition into the blending space; the vapor tap orifice through the wall means has a cross-sectional open area within the range from about 0.2 to about 0.8 $mm^2$ for flow of propellant gas into the blending space; and the ratio of capillary dip tube to vapor tap cross-sectional open area is within the range from about 1.0 to about 3.2.

21. An aerosol container according to claim 17, in which the liquid tap orifice is disposed in a tail piece passage in flow connection to a dip tube.

22. An aerosol container according to claim 12 in which the gas-permeable membrane is impermeable to liquefied propellants.

23. An aerosol container for use with compositions containing liquefied flammable propellants, and having a gas-permeable membrane that is at best only slowly permeable by liquefied propellants, and impeding liquid flow via a gas tap orifice through an open manually-operated delivery valve, at least when the container is tipped from the upright position beyond the horizontal towards the fully inverted position, the container comprising, in combination, a pressurizable container having at least one storage compartment for an aerosol composition and a liquefied propellant in which compartment liquefied propellant can assume an orientation according to orientation of the container between a horizontal and an upright position, and a horizontal and inverted position; a delivery valve movable manually between open and closed positions, and including a valve stem and a delivery port; an aerosol-conveying passage in flow connection at one end with the storage compartment via a gas tap orifice and at the other end with the delivery port, manipulation of the delivery valve opening and closing the passage to flow of aerosol composition and propellant from the storage compartment to the delivery port; means defining at least two separate compartments in the container, of which a first compartment has a volume of at least 0.5 cc and is in direct flow connection with the aerosol-conveying passage, and a second compartment is in flow connection with the aerosol-conveying passage only via the first compartment; at least one first liquid tap orifice having a diameter within the range from about 0.012 to about 0.2 cm and communicating the first and another compartment for flow of liquid aerosol composition into the first compartment from the other compartment, and of sufficiently small dimensions to restrict flow of liquid aerosol composition therethrough; the ratio of first compartment volume/first orifice diameter being from about 10/x to about 400/x, where x is 1 when the orifice length is less than 1 cm, and 2 when the orifice length is 1 cm or more; at least one second gas tap orifice having a total cross-sectional open area within the range from about $4 \times 10^{-5}$ to about $1.3 \times 10^{-2}$ $cm^2$ and communicating the first and second compartments for flow of propellant into the first compartment from the second compartment therethrough, and of sufficiently small dimensions to restrict flow of propellant gas and form bubbles of such gas in liquid aerosol composition across the line of flow thereof to the valve, thereby to foam the aerosol composition upon opening of the valve to atmospheric pressure, and to expel foamed aerosol composition through the open delivery valve; and a gas-permeable membrane that is at best only slowly permeable by liquefied propellants, disposed across the line of flow of liquefied propellant from the storage compartment to the delivery port, and impeding liquid flow via a gas tap orifice through an open manually-operated delivery valve, at least when the container is tipped from the upright position beyond the horizontal towards the fully inverted position.

24. An aerosol container according to claim 23, in which the first compartment has a volume of from about 1 to about 4 cc.

25. An aerosol container according to claim 23, having a single second gas tap orifice having a diameter within the range from about 0.076 to about 12 mm.

26. An aerosol container according to claim 23, having a capillary dip tube as the liquid tap orifice.

27. An aerosol container according to claim 23, having an orifice in a wall of the foam compartment as the liquid tap orifice.

28. An aerosol container according to claim 27, in which the container is cylindrical, with the delivery valve at one end, and the means defining the first compartment comprises a concentric inner cylinder spaced from the walls of the container surrounding and extending from the delivery valve, the gas tap orifice is through a wall of the inner cylinder, the liquid tap orifice is through a wall of the inner cylinder; a concentric outer cylinder spaced from the inner cylinder and defining therewith a storage space for collection of liquefied propellant, the membrane controlling flow into said space, and the remainder of the interior of the aerosol container outside the walls and bottom of the outer cylinder comprises an annular outer compartment for propellant and liquid aerosol composition.

29. An aerosol container according to claim 23 in which the gas-permeable membrane is impermeable to liquefied propellants.

30. An aerosol container for use with compositions containing liquefied flammable propellants, and having a gas-permeable membrane that is at best only slowly permeable by liquefied propellants, and impeding liquid flow via a gas tap orifice through an open manually-operated delivery valve, at least when the container is tipped from the upright position beyond the horizontal towards the fully inverted position, the container comprising, in combination, a pressurizable container having at least one storage compartment for an aerosol composition and a liquefied propellant in which compartment propellant can assume an orientation according to orientation of the container between a horizontal and an upright position, and a horizontal and an inverted position; a delivery valve housing; a chamber in the delivery valve housing, a delivery valve in the housing chamber movable manually between open and closed positions, and including a valve stem and a delivery port; an aerosol-conveying passage in flow connection at one end with the storage compartment via a gas tap orifice and at the other end with the delivery port, manipulation of the delivery valve opening and closing the passage to flow of aerosol composition and propellant from the storage compartment to the delivery port; and a gas-permeable membrane that is at best only slowly permeable by liquefied propellants, disposed in the delivery valve housing across the line of flow of liquefied propellant from the storage compartment to the delivery port, and impeding flow of liquefied propellant to the delivery port in all orientations of the container.

31. An aerosol container according to claim 30, in which the membrane is disposed across the line of flow between the delivery port and the gas tap orifice.

32. An aerosol container according to claim 30, in which the membrane is disposed across the delivery valve housing chamber, and across the line of flow of propellant from the gas tap orifice and of aerosol composition from the storage compartment to the delivery port.

33. An aerosol container according to claim 20 in which the delivery valve housing is shaped to receive one end of a dip tube, and the gas tap orifice is dipsosed in a wall of the housing.

34. An aerosol container according to claim 30 comprising a prefilter upstream of the membrane in the line of flow to the delivery port.

35. An aerosol container according to claim 34 in which the prefilter and membrane are juxtaposed in an array comprising a foraminous support downstream of the membrane in the line of flow to the delivery port.

36. An aerosol container according to claim 30 in which the gas-permeable membrane is impermeable to liquefied propellants.

37. An aerosol container for delivering liquid aerosol compositions highly concentrated with respect to the active ingredient at a low delivery rate, comprising, in combination, a pressurizable container having a delivery valve movable between open and closed positions, a valve stem, and a delivery port; a valve stem orifice in the valve stem in flow connection at one end with a blending space and at the other end with an aerosol-conveying valve stem passage leading to the delivery port; the valve stem orifice having a diameter within the range from about 0.33 to about 0.65 mm; bias means for holding the valve in a closed position; means for manipulating the valve against the bias means to an open position for expulsion of aerosol composition via the valve stem orifice to the delivery port; wall means defining the blending space and separating the blending space from liquid aerosol composition and propellant within the container; at least one liquid tap orifice through the wall means, having a cross-sectional open area within the range from about 0.2 and 0.8 $mm^2$ for flow of liquid aerosol composition into the blending space; at least one vapor tap orifice through the wall means, having a cross-sectional open area within the range from about 0.2 to about 0.8 $mm^2$ for flow of propellant into the blending space; the ratio of liquid tap orifice to vapor tap orifice cross-sectional open area being within the range from about 0.5 to about 2.5; the open areas of the liquid tap orifice and vapor tap orifice being selected within the stated ranges to provide a volume ratio of propellant:gas liquid aerosol composition within the range from about 8:1 to about 40:1, thereby limiting the delivery rate of liquid aerosol composition and propel any gas from the container when the delivery valve is opened; and a gas-permeable membrane that is at best only slowly permeable by liquefied propellants, extending across the blending space across the line of flow from both the vapor tap and liquid tap orifices to the blending space, and impeding liquid flow via said orifices through an open manually-operated delivery valve in all positions of the container.

38. An aerosol container according to claim 37, in which the liquid tap orifice is a capillary dip tube whose cross-sectional open area is within the range from about 0.2 to about 1.8 $mm^2$ for flow of liquid aerosol composition into the blending space; the vapor tap orifice through the wall means has a cross-sectional open area within the range from about 0.2 to about 0.8 $mm^2$ for flow of propellant gas into the blending space; and the ratio of capillary dip tube to vapor tap cross-sectional open area is within the range from about 1.0 to about 3.2.

39. An aerosol container according to claim 37, in which the blending space has a volume of from about 0.1 to about 1 cc.

40. An aerosol container according to claim 37, having a single gas tap orifice and a single liquid tap orifice.

41. An aerosol container according to claim 37, having a tail piece passage as the liquid tap orifice.

42. An aerosol container according to claim 37 in which the gas-permeable membrane is impermeable to liquefied propellants.

43. An aerosol container for use with aerosol compositions containing liquefied flammable propellants, and having a gas-permeable membrane that is at best only slowly permeable by liquefied propellants, and impeding liquid propellant flow through an open manually-operated delivery valve, at least when the container is tipped from the upright position beyond the horizontal towards the fully inverted position, the container comprising, in combination, a pressurizable container having at least one storage compartment for a liquid aerosol solution and a liquefied propellant in which compartment propellant can assume an orientation according to orientation of the container between a horizontal and an upright position, and a horizontal and an inverted position; a delivery valve housing; a chamber in the delivery valve housing; a delivery valve in the housing chamber movable manually between open and closed positions, and including a valve stem and a delivery port; an aerosol-conveying passage in flow connection at one end with the storage compartment and at the other end with the delivery port, manipulation of the delivery valve opening and closing the passage to flow of liquid aerosol solution and propellant from the storage compartment to the delivery port; and a gas-permeable membrane that is at best only slowly permeable by liquefied propellants, but is permeable to liquid aerosol solution being dispensed from the container; the membrane having a bubble point of less than 1 atmosphere, a pore size not exceeding about 25 microns, and an open area within the range from about 40 to about 90%, said membrane being disposed in the delivery valve housing across the line of flow liquefied propellant and liquid aerosol solution from the storage compartment to the delivery port, and impeding flow of liquefied propellant to the delivery port in all orientations of the container.

44. An aerosol container according to claim 43, in which the membrane is disposed across the line of flow between the delivery port and a dip tube tapping the storage compartment.

45. An aerosol container according to claim 43 in which the gas-permeable membrane is impermeable to liquefied propellants.

* * * * *

UNITED STATES PATENT AND TRADEMARK OFFICE

CERTIFICATE OF CORRECTION

PATENT NO. : 4,141,472

DATED : February 27, 1979

INVENTOR(S) : Joseph G. Spitzer et al

It is certified that error appears in the above-identified patent and that said Letters Patent are hereby corrected as shown below:

| | | |
|---|---|---|
| Column 1, line 20 | : | "Pat." should be --Pats.--. |
| Column 1, line 59 | : | "intermediate" should be --indeterminate--. |
| Column 2, line 20 | : | "porportion" should be --proportion--. |
| Column 2, line 50 | : | "liqueified" should be --liquefied--. |
| Column 4, line 32 | : | Please delete "the", second occurrence. |
| Column 4, line 43 | : | "propellent" should be --propellant--. |
| Column 5, line 60 | : | "0.6 should be --0.8--. |
| Column 5, line 64 | : | "0.4" should be --0.3-- and "0.8 should be --0.5--. |
| Column 5, line 67 | : | "0.5" should be --1.4-- and "0.9" should be --2.3--. |
| Column 6, line 54 | : | Please delete the hyphen"(-)" at the end of line |
| Column 7, line 18 | : | "Nos." should be --No.--. |
| Column 7, line 19 | : | "wnen" should be --when--. |
| Column 10, line 12 | : | "oepn" should be --open--. |
| Column 12, line 67 | : | "respect" should be --regard--. |
| Column 13, line 43 | : | "ar" should be --are--. |
| Column 16, line 19 | : | "ratio" should be --rate--. |
| Column 17, line 5 | : | "popppet" should be --poppet--. |
| Column 17, line 29 | : | "popped" should be --poppet--. |
| Column 18, line 10 | : | "gap" should be --cap--. |
| Column 19, line 14 | : | "heatsealed" should be --heat-sealed--. |
| Column 19, line 61 | : | "conentration" should be --concentration--. |
| Column 19, line 64 | : | "standarized" should be --standardized--. |

UNITED STATES PATENT AND TRADEMARK OFFICE

CERTIFICATE OF CORRECTION

PATENT NO. : 4,141,472

DATED : February 27, 1979

INVENTOR(S) : Joseph G. Spitzer et al.

It is certified that error appears in the above-identified patent and that said Letters Patent are hereby corrected as shown below:

| | | |
|---|---|---|
| Column 27, line 57 | : | "blanding" should be --blending--. |
| Column 29, line 52 | : | "and" should be --to--. |
| Column 29, line 55 | : | "cross-sectinal" should be --cross-sectional--. |
| Column 33, line 23 | : | "and" should be --to--. |
| Column 34, line 42 | : | Please insert --of-- after "flow". |

Signed and Sealed this

*Fifteenth* Day of *January 1980*

[SEAL]

*Attest:*

SIDNEY A. DIAMOND

*Attesting Officer*

*Commissioner of Patents and Trademarks*